US010502197B2

(12) United States Patent
Alexander et al.

(10) Patent No.: US 10,502,197 B2
(45) **Date of Patent: *Dec. 10, 2019**

(54) PUMP

(71) Applicant: FNA Group, Inc., Pleasant Prairie, WI (US)

(72) Inventors: Gus Alexander, Inverness, IL (US); Paulo Rogerio Funk Kolicheski, Gurnee, IL (US)

(73) Assignee: FNA Group, Inc., Pleasant Prairie, WI (US)

( * ) Notice: Subject to any disclaimer, the term of this patent is extended or adjusted under 35 U.S.C. 154(b) by 99 days.

This patent is subject to a terminal disclaimer.

(21) Appl. No.: 15/852,135

(22) Filed: Dec. 22, 2017

(65) Prior Publication Data

US 2018/0223816 A1 Aug. 9, 2018

Related U.S. Application Data

(63) Continuation of application No. 14/955,457, filed on Dec. 1, 2015, now Pat. No. 9,850,884.

(60) Provisional application No. 62/085,775, filed on Dec. 1, 2014.

(51) Int. Cl.

| | |
|---|---|
| ***F04B 1/29*** | (2006.01) |
| ***F04B 1/26*** | (2006.01) |
| ***F01B 3/10*** | (2006.01) |

(52) U.S. Cl.

CPC ..... *F04B 1/124* (2013.01); *F01B 3/102* (2013.01); *F04B 1/146* (2013.01); *F04B 1/26* (2013.01); *F04B 1/295* (2013.01); *F15B 2211/20553* (2013.01)

(58) Field of Classification Search

CPC ..... F04B 1/124; F04B 1/146; F04B 1/295; F04B 1/324; F01B 3/102; F01B 3/106

See application file for complete search history.

(56) References Cited

U.S. PATENT DOCUMENTS

| | | | | | |
|---|---|---|---|---|---|
| 3,376,822 | A * | 4/1968 | Leduc | F04B 1/146 | 92/12.2 |
| 3,873,240 | A * | 3/1975 | Leduc | F04B 1/295 | 417/222.1 |
| 4,137,013 | A * | 1/1979 | Woodruff | F04B 1/295 | 417/222.1 |
| 4,294,139 | A * | 10/1981 | Bex | F01B 3/102 | 91/506 |

(Continued)

*Primary Examiner* — Michael Leslie

(74) *Attorney, Agent, or Firm* — Jeffrey T. Placker; Holland & Knight LLP

(57) ABSTRACT

In an embodiment, a variable flow pump may include a swashplate rotatably driven by a driveshaft. The swashplate may be movable between a first and second tilt angle relative to the driveshaft. A piston pump may be reciprocatingly driven by the swashplate based upon, at least in part, the tilt angle of the swashplate. An actuator piston may be moveable between a first and second position based upon, at least in part, a downstream backpressure of a fluid pumped by the piston pump. An actuator assembly may be moveable between a first and second position based upon, at least in part, the position of the actuator piston. The actuator assembly may include a swashplate driver configured urge the swashplate between the first and second tilt angles, and a biasing driver configured to apply a force urging the swashplate into contact with the swashplate driver.

20 Claims, 22 Drawing Sheets

(56) References Cited

U.S. PATENT DOCUMENTS

| | | | | | |
|---|---|---|---|---|---|
| 4,703,682 | A * | 11/1987 | Hansen | F01B 3/102 | 91/506 |
| 5,440,878 | A * | 8/1995 | Gleasman | F01B 3/02 | 91/506 |
| 6,408,622 | B1 * | 6/2002 | Tsuruga | E02F 9/2207 | 60/422 |
| 9,850,884 | B2 * | 12/2017 | Alexander | F04B 1/124 | |

* cited by examiner

PUMP

RELATED APPLICATIONS

The subject application is a continuation application of U.S. patent application Ser. No. 14/955,457, filed on Dec. 1, 2015, now U.S. Pat. No. 9,850,884, issued on Dec. 26, 2017, which claims the benefit of U.S. Provisional Application Ser. No. 62/085,775, filed on Dec. 1, 2014, the entire contents of which are incorporated herein by reference.

CROSS-REFERENCE TO RELATED APPLICATION

This application claims the benefit of U.S. provisional patent application Ser. No. 62/085,775, filed on Dec. 1, 2014, entitled "PUMP," the entire disclosure of which is incorporated herein by reference.

TECHNICAL FIELD

The present disclosure generally relates to pumps, and more particularly relates to variable flow rate pump.

BACKGROUND

Many domestic and commercial water usage applications may require relatively high pressures, which may be beyond the capacity of residential and/or municipal water distribution and supply systems. For example, heavy duty cleaning applications may benefit from increased spraying pressure that is greater than the pressure available for common residential and/or municipal water distribution and supply systems. In some situations, various nozzles may be utilized to constrict the flow of the water to provide an increase in the pressure of the resultant water stream. However, many tasks may benefit from even greater pressures than can be achieved with common pressure nozzles that may be attached to a hose. In such circumstances pressure washers may be utilized, in which a power driven pump may be employed to increase the pressure significantly above pressures that are readily achievable using hose attachments. Such elevated pressures may greatly increase the efficiency and/or effectiveness of some cleaning and spraying tasks.

While the increase in pressure that may be provided by a pressure washer may be useful for many applications, in many circumstances the demand for the pressurized water may be intermittent, or required on a stop and go basis. Often the intermittent demand for the pressurized water is satisfied by various valves or flow restrictors that may be located in the nozzle of the pressure washer, or at some location between the pressure pump of the pressure washer and the nozzle. While valves of this nature may satisfy the intermittent demand for the pressurized water, when the valve is closed the pump may be continue trying to pump against the closed valve, which may impart stress on the pump and/or the prime mover. The stress imparted on the pump and/or the prime mover working against the closed valve may, in some situations, accelerate wear on the pump or prime mover, or otherwise decrease the useful life cycle of the components.

SUMMARY

According to an embodiment, a variable flow pump may include a swashplate coupled with a driveshaft for rotatably driving the swashplate. The swashplate may be movable between a first tilt angle relative to the driveshaft and a second tilt angle relative to the driveshaft. A piston pump may interact with the swashplate for being reciprocatingly driven based upon, at least in part, the tilt angle of the swashplate. An actuator piston may be moveable between a first position and a second position based upon, at least in part, a downstream backpressure of a fluid pumped by the piston pump. An actuator assembly may be moveable between a first position and a second position based upon, at least in part, the position of the actuator piston. The actuator assembly may include a swashplate driver configured urge the swashplate between the first tilt angle and the second tilt angle. The actuator assembly may also include a biasing driver configured to apply a force urging the swashplate into contact with the swashplate driver.

One or more of the following features may be included. The swashplate may be pivotally coupled to the driveshaft for tilting movement relative to the driveshaft. The piston pump may be radially spaced from a longitudinal axis of the driveshaft. The variable flow pump may include a plurality of piston pumps radially spaced around the longitudinal axis of the driveshaft. The piston pump may be reciprocatingly driven a relatively smaller displacement when the swashplate is at the first tilt angle. The piston pump may be reciprocatingly driven a relatively larger displacement when the swashplate is at the second tilt angle.

At least a portion of the actuator piston may be part the actuator assembly. The actuator piston may include an annular piston positioned around a longitudinal axis of the driveshaft. The actuator piston may include a plurality of pistons radially spaced around a longitudinal axis of the driveshaft.

The actuator assembly may further include a biasing member biasing the actuator assembly toward the second position. The biasing member may include a mainspring disposed around a longitudinal axis of the driveshaft. The biasing member may include a plurality of springs radially spaced around a longitudinal axis of the driveshaft. The swashplate driver may include a fixed-length member transmitting displacement between an actuator body of the actuator assembly and the swashplate. The biasing driver may include an expandable member disposed between an actuator body of the actuator assembly and the swashplate. The expandable member may include a spring loaded pin.

According to another implementation, a variable flow pump may include a swashplate coupled with a driveshaft for rotatably driving the swashplate. The swashplate may be movable between a first tilt angle relative to the driveshaft and a second tilt angle relative to the driveshaft. A piston pump may interact with the swashplate for being reciprocatingly driven based upon, at least in part, the tilt angle of the swashplate. An actuator may be coupled with the swashplate for moving the swashplate between the first tilt angle and the second tilt angle based upon, at least in part, a downstream backpressure of a fluid pumped by the piston pump.

One or more of the following features may be included. The actuator may include an actuator piston moveable between a first position and a second position based upon, at least in part, the downstream backpressure of the fluid pumped by the piston pump. The actuator may include a biasing member biasing the swashplate toward the second tilt angle, the actuator piston at least partially countering the biasing member to move the swashplate to the first tilt angle.

According to yet another implementation, a variable flow pump may include a driveshaft rotatably driven by a prime mover. A swashplate may be coupled with the driveshaft for rotatably driving the swashplate. The swashplate may be pivotally coupled with the drive shaft and may be movable between a first tilt angle relative to the drive shaft and a second tilt angle relative to the driveshaft. An actuator piston may be fluidly coupled with a pumped fluid for moving the actuator piston between a first position and a second position based upon, at least in part, a pressure of the pumped fluid. An actuator assembly may be coupled with the swashplate and the actuator piston. The actuator assembly may be configured for moving the swashplate to the first tilt angle when the actuator piston is in the first position. The actuator assembly may be configured for moving the swashplate to the second tilt angle when the actuator piston is in the second position.

One or more of the following features may be included. The actuator assembly may include a swashplate driver moving the swashplate between the first tilt angle and the second tilt angle. The actuator assembly may also include a biasing driver configured to apply a force urging the swashplate into contact with the swashplate driver. The swashplate driver may include a fixed-length member. The biasing driver may include a spring-driven member. The swashplate driver and the biasing driver may be disposed on opposed sides of the pivotal coupling between the driveshaft and the swashplate.

DESCRIPTION OF EXAMPLE EMBODIMENTS

Figure 1:
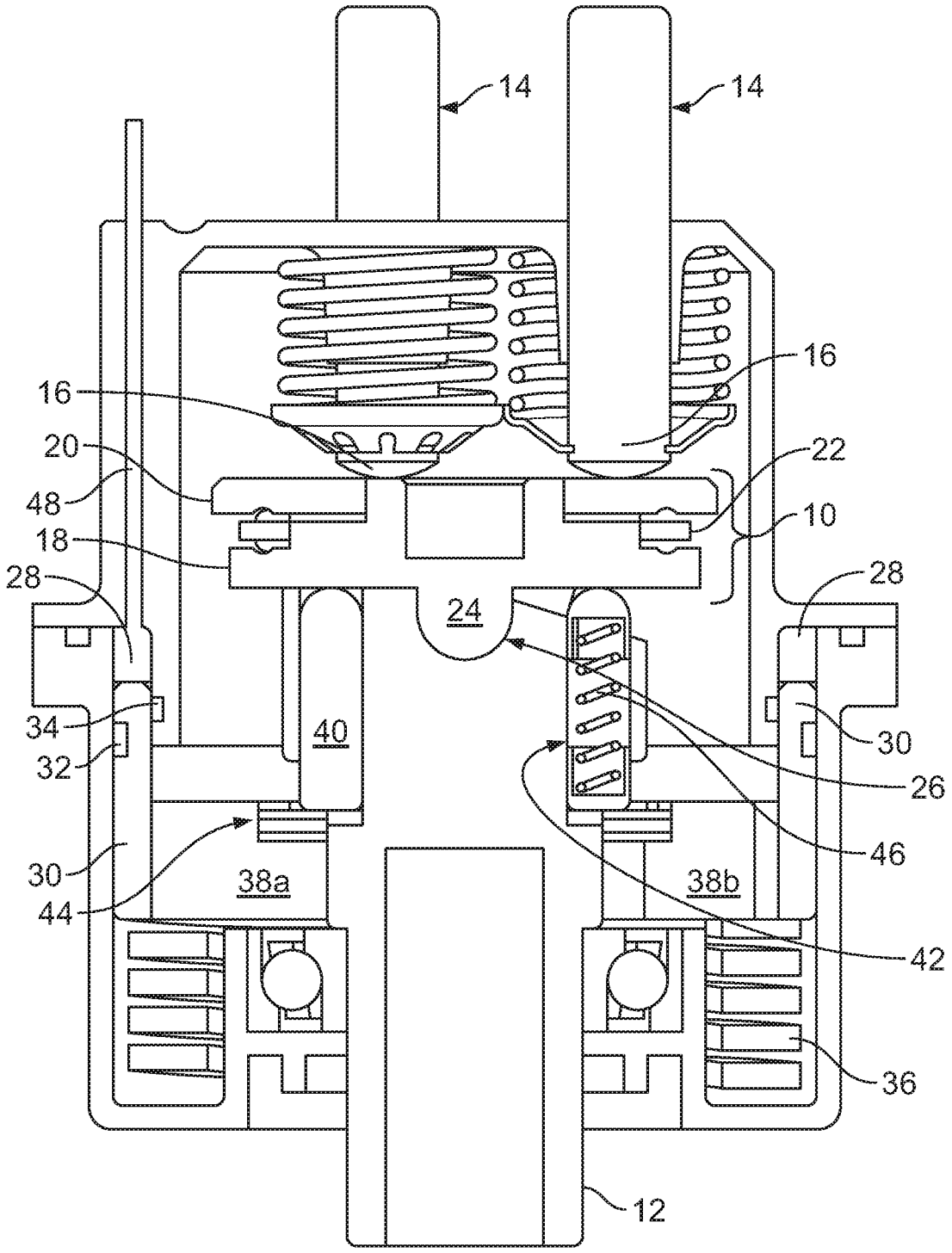
FIG. 1 diagrammatically depicts a variable flow pump according to a first illustrative example embodiment.

According to an embodiment, the present disclosure may generally relate to a variable flow rate pump. In some embodiments, the variable flow rate pump may be utilized in a pressure washer system. Generally, the pressure washer system may receive an input flow of water, for example, from a domestic or municipal water supply or the like, and may utilize a pump to provide an output flow of the water having a greater pressure than the input flow. It will be appreciated that while the present disclosure may generally be described in the context of pumping water for use with a pressure washer system, a pump consistent with the present disclosure may suitable be used an a variety of applications for pumping a wide variety of fluids.

According to an embodiment, a variable flow pump may include a swashplate coupled with a driveshaft for rotatably driving the swashplate. The swashplate may be movable between at least a first tilt angle relative to the driveshaft and a second tilt angle relative to the driveshaft. A piston pump may interact with the swashplate for being reciprocatingly driven based upon, at least in part, the tilt angle of the swashplate. An actuator piston may be moveable between a first position and a second position based upon, at least in part, a downstream backpressure of a fluid pumped by the piston pump. An actuator assembly may be moveable between a first position and a second position based upon, at least in part, the position of the actuator piston. The actuator assembly may include a swashplate driver configured urge the swashplate between the first tilt angle and the second tilt angle. The actuator assembly may also include a biasing driver configured to apply a force urging the swashplate into contact with the swashplate driver.

Referring to the drawings, in an embodiment, the variable flow rate pump may generally include a swashplate, or cam plate (e.g., swashplate 10, generally) that may be coupled to a driveshaft so as to be rotationally driven by the driveshaft 12. The driveshaft 12 may be driven by prime mover, such as an engine (e.g., a gasoline engine, a vehicle power take off, etc.) an electric motor, or other suitable source of rotational power. The swashplate 10 may interact with one or more piston pumps (e.g., piston pump 14) for axially driving a plunger 16 of the piston pump 14 in a reciprocating manner. For example, the swashplate 10 may be oriented at an angle relative to the driveshaft 12 (e.g., at a non-perpendicular angle relative to the axis of rotation of the driveshaft 12), and therein also at an angle to the axis of the plunger 16 of the piston pump 14. As such, the swashplate 10 may present slanted face relative to the plunger 16. As the swashplate rotates, the slanted face of the swashplate may drive the plunger 16 in a reciprocating manner to allow the piston pump 14 to pump water. In this regard, in an embodiment, the piston pump may be radially spaced from a longitudinal axis of the driveshaft. It will be appreciated that the piston pump 14 may include one or more check valves to control the directional flow of the water through the piston pump 14 such that the desired pumping action actually occurs. Further, while a single piston pump is generally described, it will be appreciate that a variable flow pump consistent with the present disclosure may include more than one piston pump, each of which may be reciprocatingly driven by the swashplate. In this regard, in some embodiments, a plurality of piston pumps may be disposed around the swashplate and may be radially spaced from the longitudinal axis of the driveshaft.

In an embodiment, the swashplate 10 may be configured to reduce frictional losses between the rotating swashplate 10 and the rotationally-stationary (e.g., relative to the swashplate) piston pump. For example, in an embodiment the swashplate 10 may include a first plate 18 and a second plate 20 that may tilt together and/or be commonly angled relative to the driveshaft 12. The first plate 18 and the second plate 20 may be configured to rotated (e.g., about the axis of the driveshaft 12) independently from one another. For example, the first plate 18 may rotate with the driveshaft 12, and the second plate 20 may be rotationally stationary and/or rotate at a different (e.g., slower) speed than the first plate 18. Allowing the second plate 20 to remain rotationally stationary may, for example, reduce wear, damage, and/or frictional losses between the swashplate 10 and the piston pump 14. In an embodiment, the swashplate 10 may include a bearing (e.g., bearing 22) disposed between the first plate 18 and the second plate 20. The bearing 22 may reduce frictional losses between the first plate 18 and the second plate 20, for example, in a situation in which the first plate 18 may rotate with the driveshaft 12 and the second plate 20 may remain rotationally stationary (and/or may rotate at a slower speed than the first plate 18. The bearing 22 may include, for example, a ball bearing assembly, a roller bearing assembly, a plain bearing (e.g., including a low friction material—such as bronze, or another relatively low friction metal, Teflon® or another relatively low friction plastic, or another relatively low friction material—disposed between the first plate 18 and the second plate 20), or some other suitable bearing arrangement. In addition/as an alternative to including a discrete component from the first plate 18 and the second plate 20, the bearing 22 may be at least partially integrated with one or more of the first plate 18 and the second plate 20. For example, the bearing 22 may include a bearing material bonded or attached to one or more of the facing surfaces of the first plate 18 and the second plate 20.

In some embodiments, in addition, or as an alternative, to the independently rotatable first plate 18 and second plate 20, the frictional losses and/or wear between the swashplate 10 and the piston pump 14 may be reduced by reducing the frictional interactions between the swashplate 10 and the piston pump 14. For example, in an embodiment, the distal end of the plunger 16 (e.g., the end of the plunger in contact with the swashplate 10) of the piston pump 14 may include a roller (not shown in the illustrated example). The roller may allow the swashplate 10 to rotate relative to the piston pump 14 while reducing the frictional interaction between the swashplate 10 and the plunger 16. In related embodiments, the swashplate 10 and/or the plunger 16 may include a low friction material that may allow for relatively low friction and/or low wear sliding motion between the swashplate 10 and the plunger. Other configurations may similarly be implemented.

According to an embodiment, and as generally discussed above, the variable flow rate pump may utilize a single piston pump. Further, in some embodiments, the variable flow rate pump may utilize a plurality of piston pumps. In an embodiment utilizing a plurality of piston pumps, a relatively higher flow rate (e.g., for similar operating conditions and as compared to a single piston pump having a similar volume as one of the plurality of piston pumps) may be achieved as a result of the combined pumping volume of the plurality of piston pumps. For example, the variable flow rate pump may include two or more piston pumps that may be radially space around the rotational axis (i.e., the longitudinal axis) of the driveshaft 12. It will be appreciated that the number of piston pumps utilized in the variable flow rate pump may be selected based upon desired pumping capacity and individual piston pump volume. Further, it will be appreciated that the pumping flow rate may be based upon, at least in part, the rotational speed of the swash plate 10 and driveshaft 12, which may be a function of the rotational input speed provided by the prime mover. For example, the greater the rotational speed of the swashplate 10 and the driveshaft 12, the greater the number of pumping cycles per unit time expressed by the piston pump(s) 14.

As generally mentioned above, the swashplate 10 may be configured to be oriented at more than one angle relative to the driveshaft 12. For example, the swashplate 10 may be moveable between at least a first tilt angle relative to the driveshaft 12 and at least a second tilt angle relative to the driveshaft. In an embodiment, the flow rate of the piston pump may be related to the angle of the swashplate 10 relative to the driveshaft 12 (e.g., and relative to the piston pump 14). When the swashplate 10 is oriented at a relatively larger angle away from a perpendicular orientation to the axis of the driveshaft 12 (e.g., the second tilt angle), the piston pump may be reciprocatingly driven a relatively larger displacement. That is, rotation of the swashplate 10 relative to the piston pump 14 may result in a relatively lager displacement (or stroke) of the piston plunger 16, which may result in a relatively larger volume of fluid being pumped by the piston pump 14 in a given pump cycle (e.g., rotation of the swashplate 10). In a similar manner, when the swashplate 10 is oriented at a relatively smaller angle away from a perpendicular orientation to the axis of the driveshaft 12 (e.g., the first tilt angle), the piston pump may be reciprocatingly driven a relatively smaller displacement. That is, the rotation of the swashplate relative to the piston pump 14 may result in a relatively smaller displacement, or stroke, of the piston plunger 16. The relatively smaller stroke of the piston plunger 16 may result in a relatively smaller volume of fluid being pumped by the piston pump 14 in a given pump cycle. In an extreme example, in which the swashplate is oriented perpendicularly to the axis of the driveshaft 12, rotation of the swashplate 10 may not result in any displacement of the piston plunger 16. In such a situation, no fluid (and/or nominally no fluid) may be pumped by the piston pump in a given pump cycle. For the convenience of description, the swashplate is described as being oriented at, and/or moveable between, at least a first tilt angle (e.g., an angle providing relatively less reciprocating displacement of the piston pump) and a second tilt angle (e.g., an angle providing relatively more reciprocating displacement of the piston pump). However, such description of the first tilt angle and the second tilt angle is intended for the purpose of convenient description. It will be appreciated that in some embodiments the swashplate may be oriented at, and/or moveable between, multiple different tilt angles (e.g., which may provide relatively different reciprocating displacements of the piston pump). Further, in some embodiments, the swashplate may be continuously variably moveable between (and/or oriented at) any tilt angle between a maximum tilt angle and a minimum tilt angle. The maximum tilt angle and the minimum tilt angle may be based upon, at least in part, one or more of a maximum and minimum movement of an actuator, limit stops associated with the variable flow pump (e.g., the actuator, the driveshaft, or other features of the variable flow pump), or the like. It will be similarly understood that other features of the variable flow pump that are described as having, and/or being moveable between, a first position and a second position are described as such for the convenience of discussion. All such features may be moveable between (and/or may be positionable at) a plurality of positions, including being continuously variably movable (and/or positionable) at any position between a minimum position and a maximum position.

Consistent with the foregoing, the swashplate 10 may be configured to be oriented at a plurality of angles relative to the driveshaft 12 to achieve different pumping flow rates (e.g., at a given rotational speed of the driveshaft 12). As used herein, discussion of the angle of the swashplate relative to the driveshaft may generally refer to the angle of the swashplate relative to an orientation of the swashplate that is perpendicular to the axis of rotation of the driveshaft (i.e., perpendicular to the longitudinal axis of the driveshaft). As such, the swashplate may be pivotally coupled to the driveshaft for tilting movement of the swashplate relative to the driveshaft. In the illustrated example embodiment, the swashplate 10 may include a rounded pivot 24 that may be received in a recess (recess 26, generally) in the driveshaft 12. In the illustrated example embodiment, the pivot 24 may have a generally hemicylindrical shape. Further, in the illustrated example embodiment, the recess 26 may be a generally complimentary rounded groove that may be oriented generally perpendicular to the axis of the driveshaft 12. Consistent with this example embodiment, the hemicylindrical pivot 24 and generally complimentary recess 26 may allow the driveshaft 12 to transmit rotational motion to the swashplate 10, while allowing the swashplate 10 to pivot relative to the rotational axis of the driveshaft 12. While the pivot 24 is shown as being a generally integral feature of the first plate 18 of the swashplate, it will be appreciated that the pivot may be formed as a separate component from the swashplate 10, and may be suitably coupled with the swashplate, for example, using a shaft pin or axle. Similarly, while recess 26 is shown in the illustrated example as being a groove formed in the driveshaft 12, it will be appreciated that the complimentary pivot feature may be separate from the driveshaft 12, and may be coupled to the driveshaft 12 in any suitable manner. Further, it will be appreciated that while the swashplate 10 has been depicted including the protruding pivot 24 and the driveshaft 12 has been shown including a complimentary recess 26, it will be appreciated that the swashplate 10 may be formed including the complimentary recess and the driveshaft may be provided including a protruding pivot feature. Further, it will be appreciated that other pivot and recess shapes and/or other pivot configurations may be equally utilized.

Figure 2:
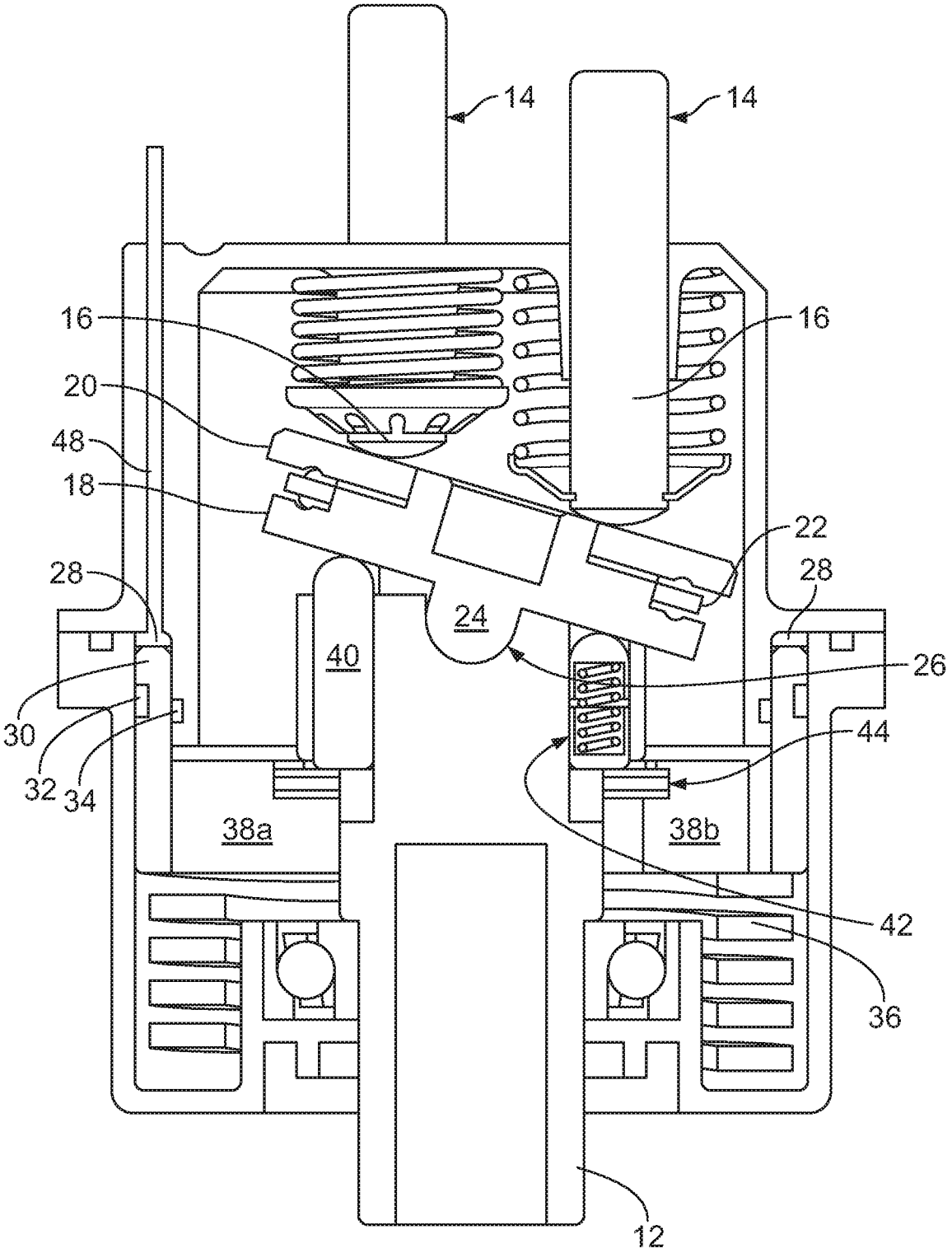
FIG. 2 diagrammatically depicts the variable flow pump according to the first illustrative example embodiment.
Figure 3:
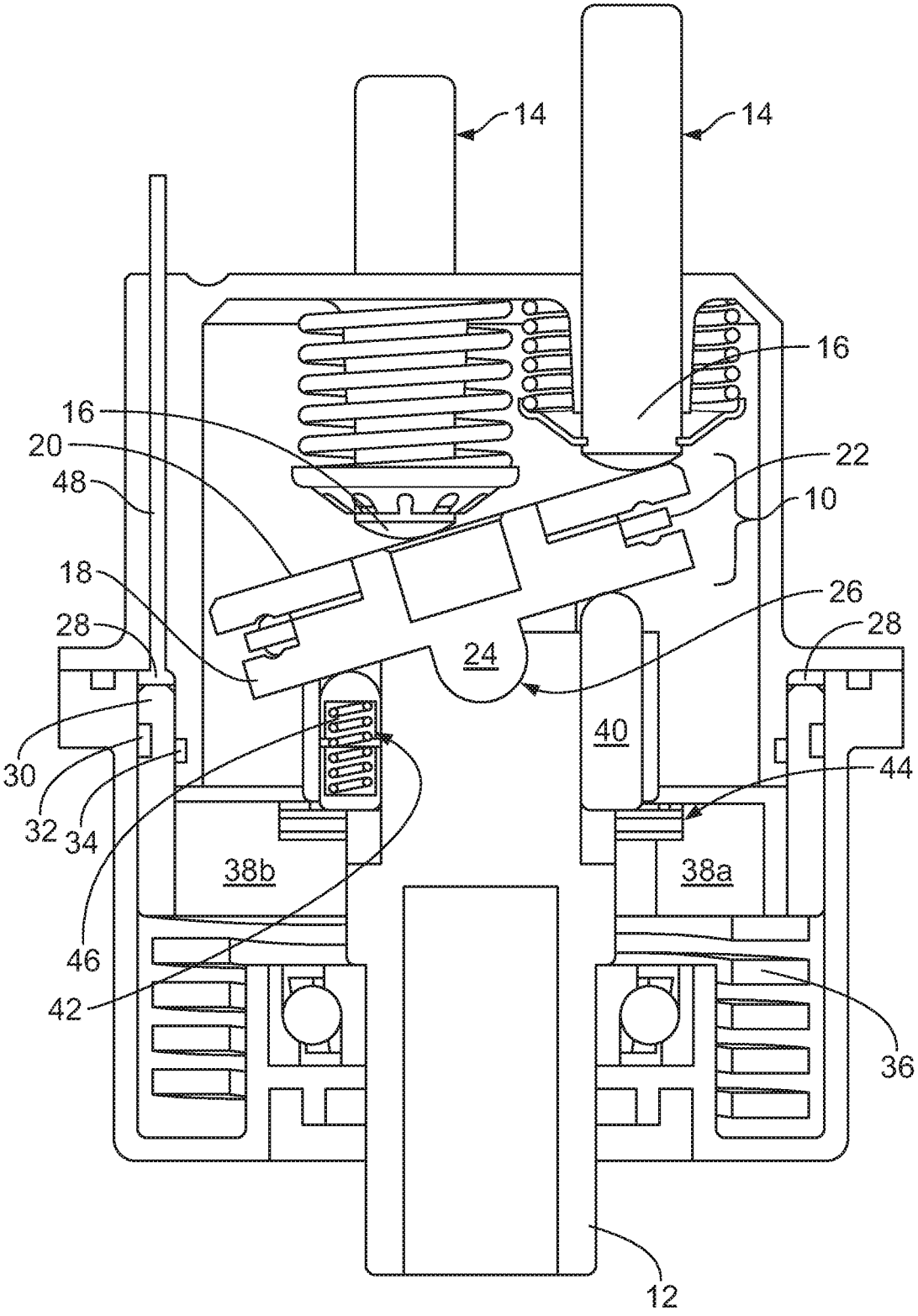
FIG. 3 diagrammatically depicts the variable flow pump according to the first illustrative example embodiment.
Figure 4:
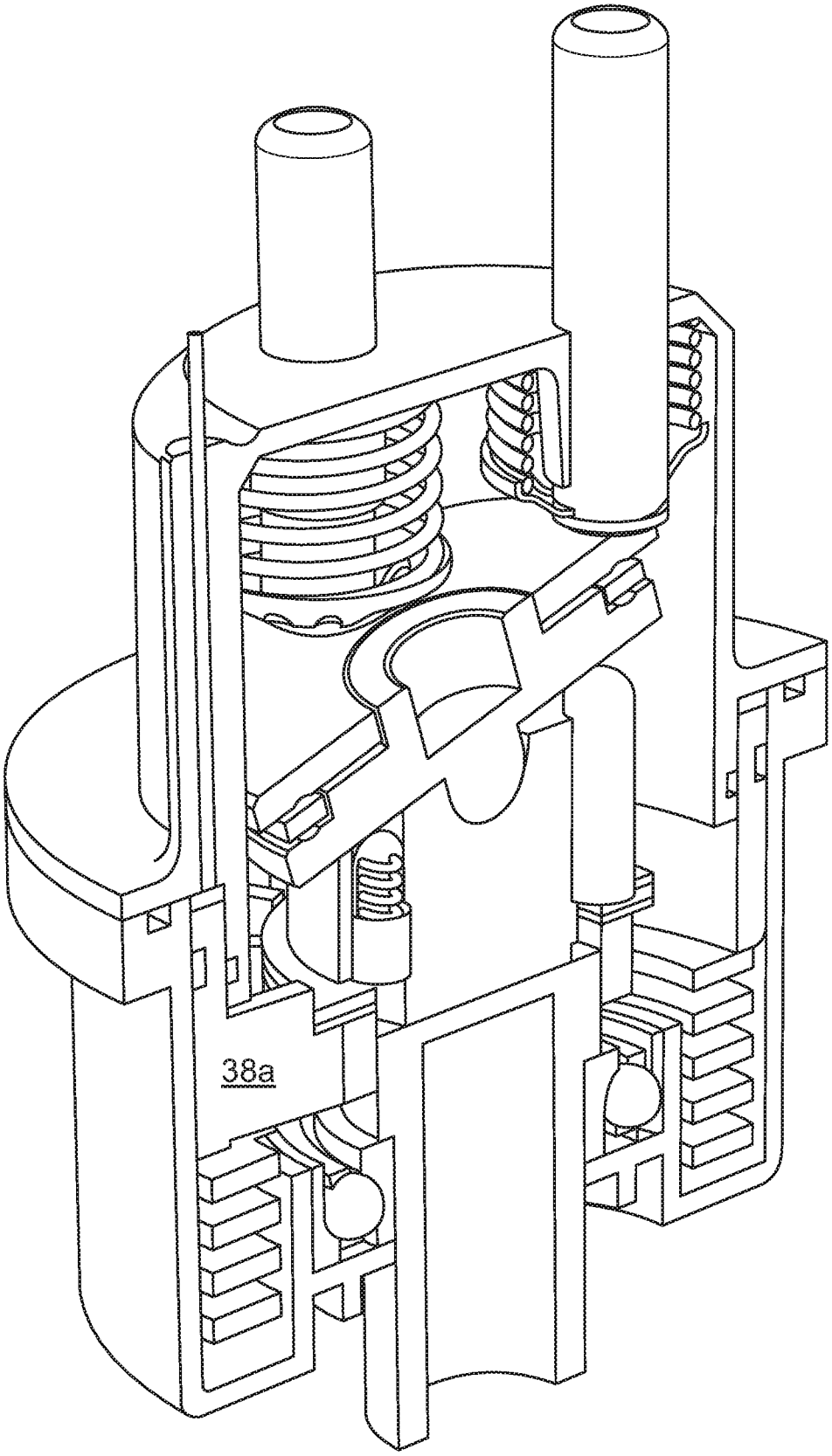
FIG. 4 is a cross-sectional view of the variable flow pump according to the first illustrative example embodiment.
Figure 5:
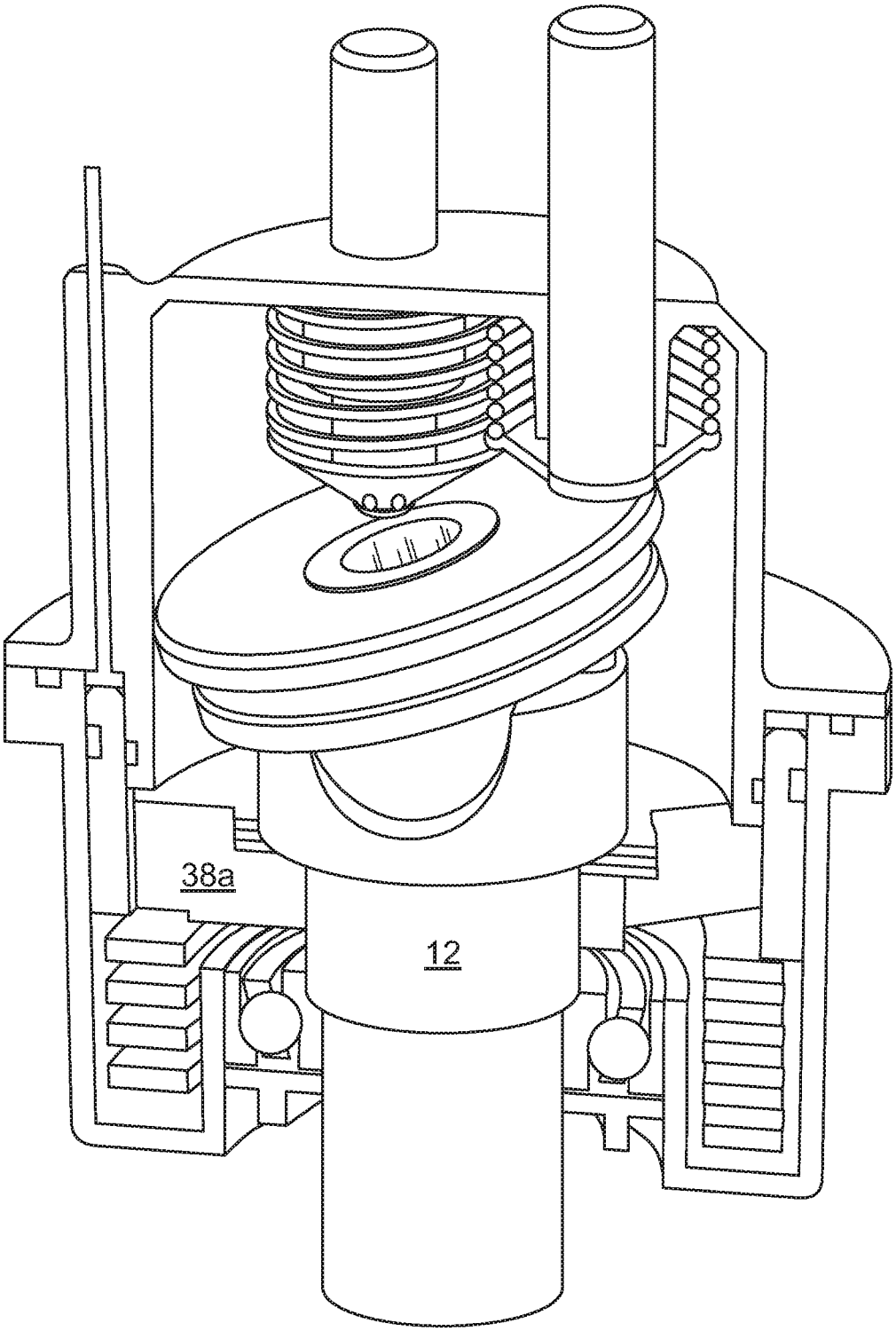
FIG. 5 is a partial cross-sectional view of the variable flow pump according to the first illustrative example embodiment.
Figure 6:
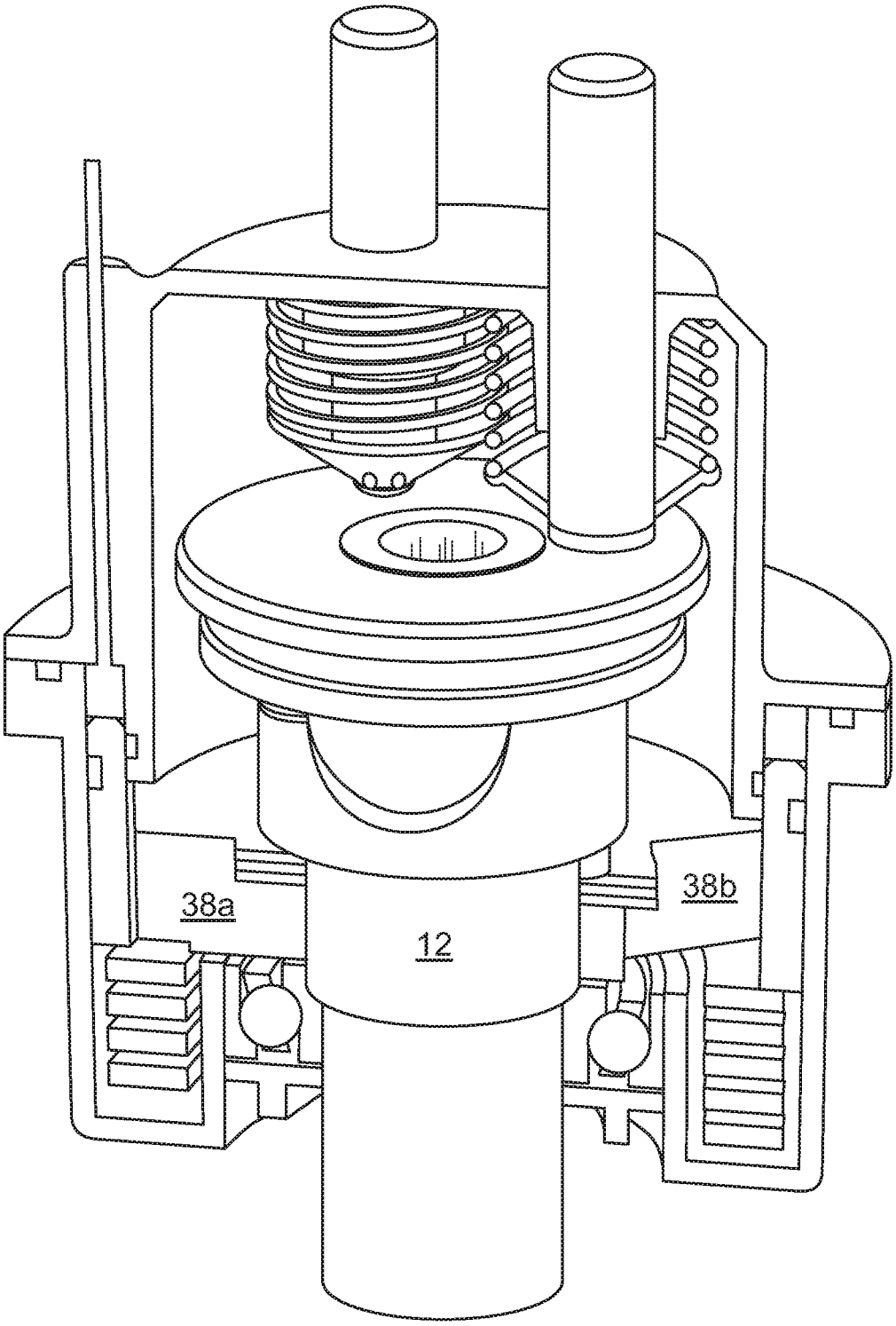
FIG. 6 is a partial cross-sectional view of the variable flow pump according to the first illustrative example embodiment.
Figure 7:
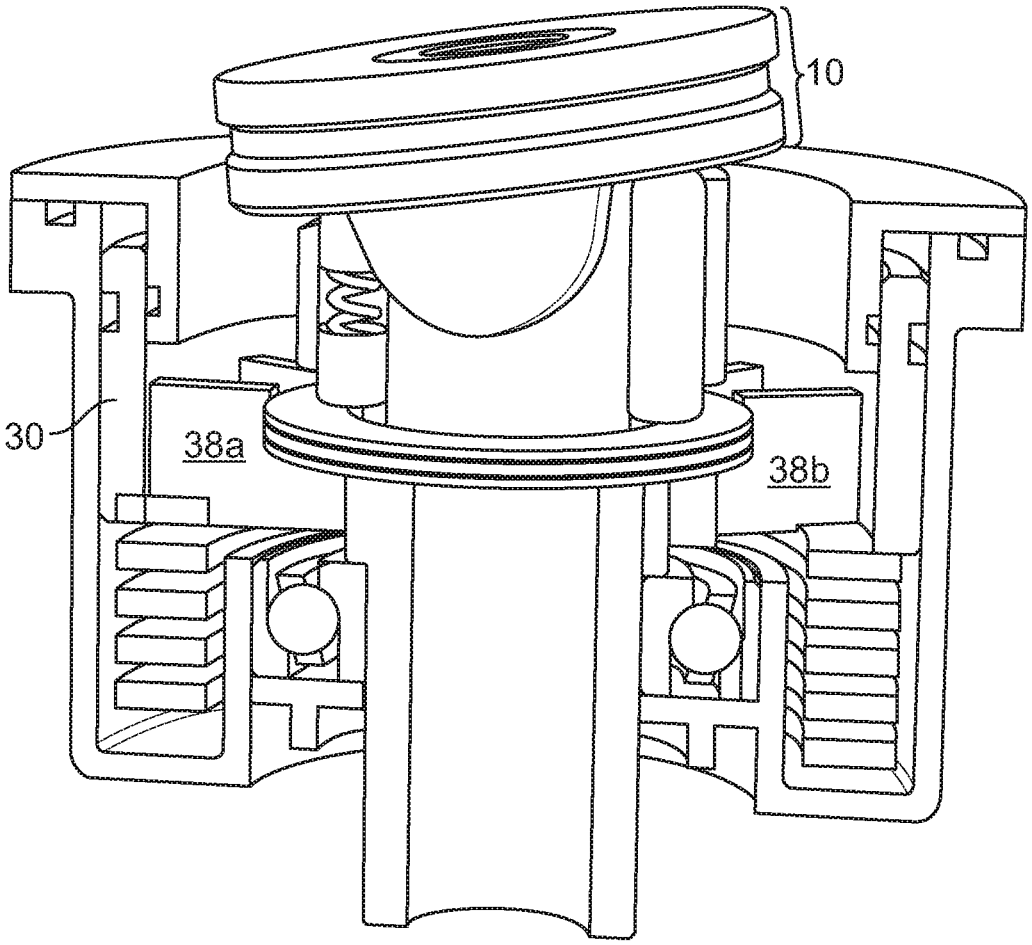
FIG. 7 diagrammatically depicts a partial cross-sectional view of a portion of the variable flow pump according to the first illustrative example embodiment.
Figure 8:
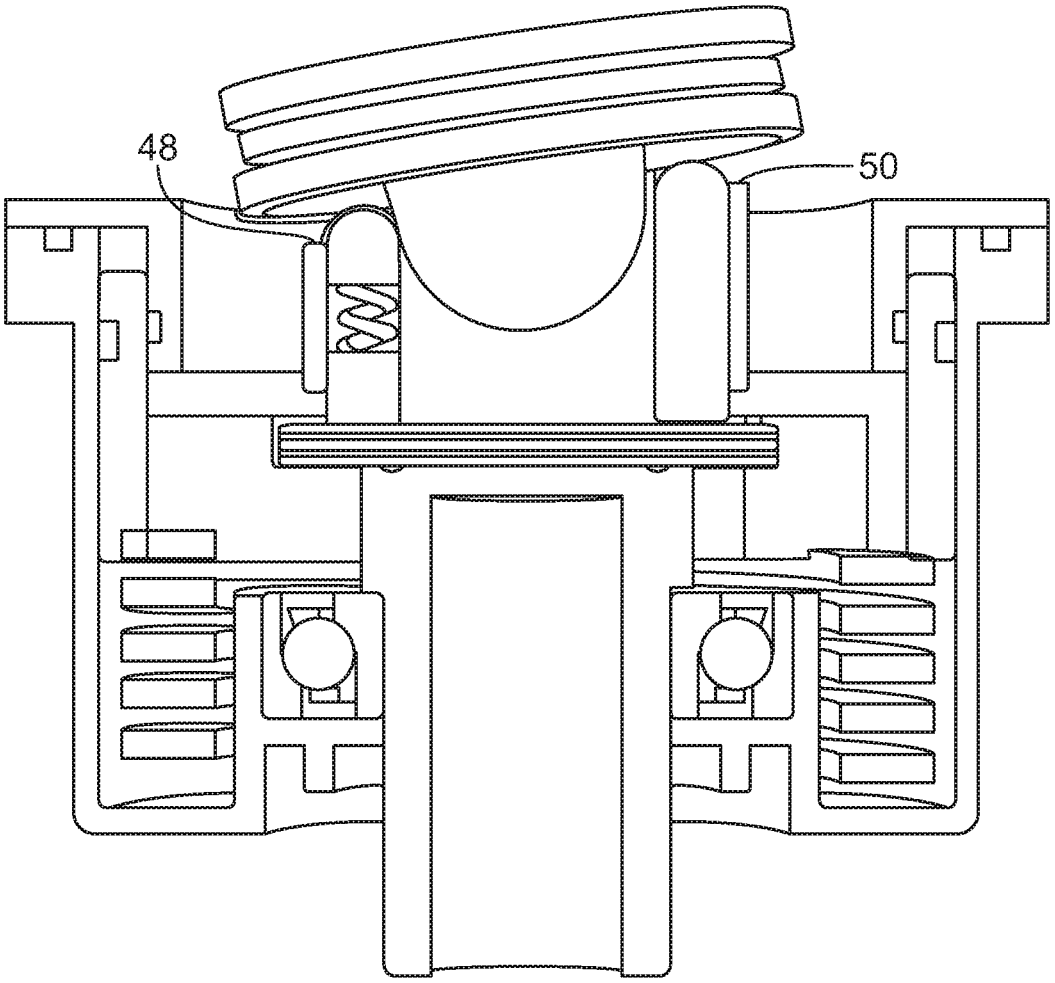
FIG. 8 diagrammatically depicts a partial cross-sectional view of a portion of the variable flow pump according to the first illustrative example embodiment.
Figure 9:
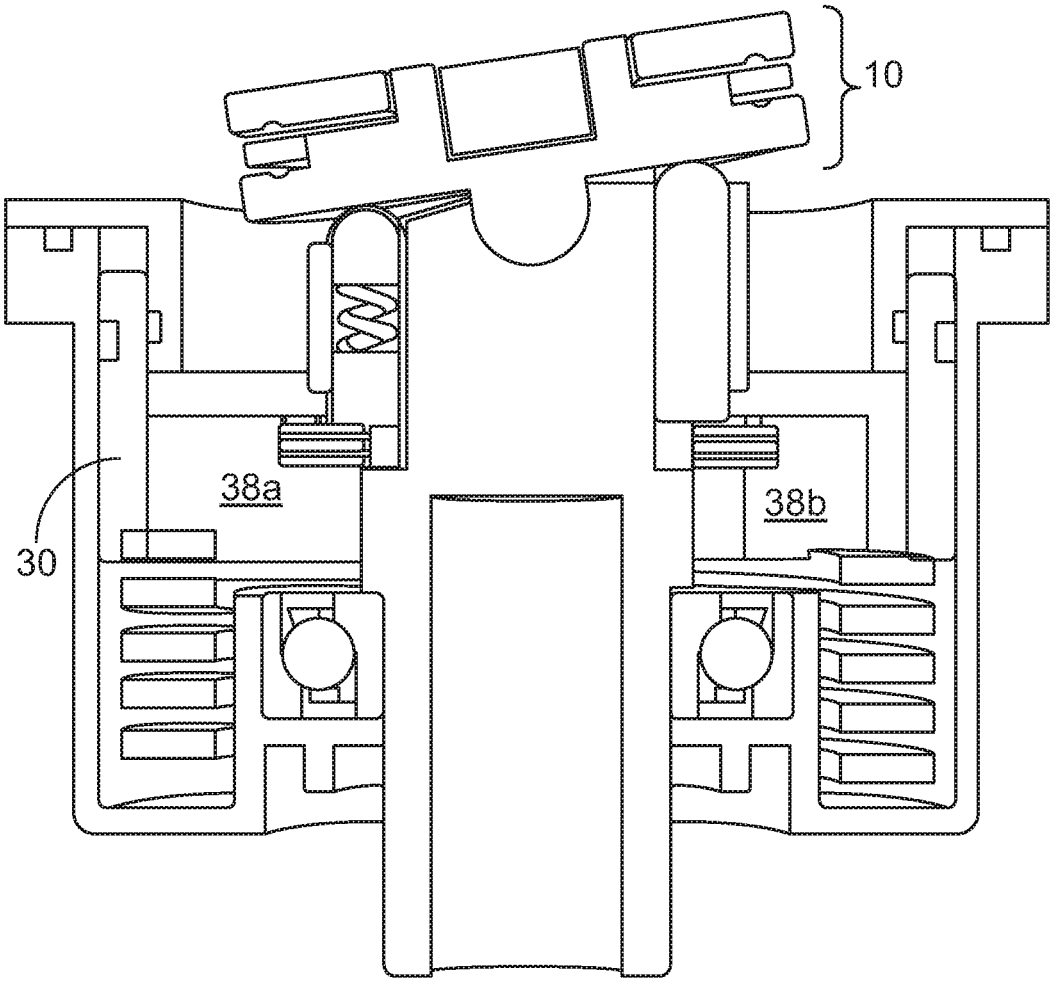
FIG. 9 diagrammatically depicts a cross-sectional view of a portion of the variable flow pump according to the first illustrative example embodiment.
Figure 10:
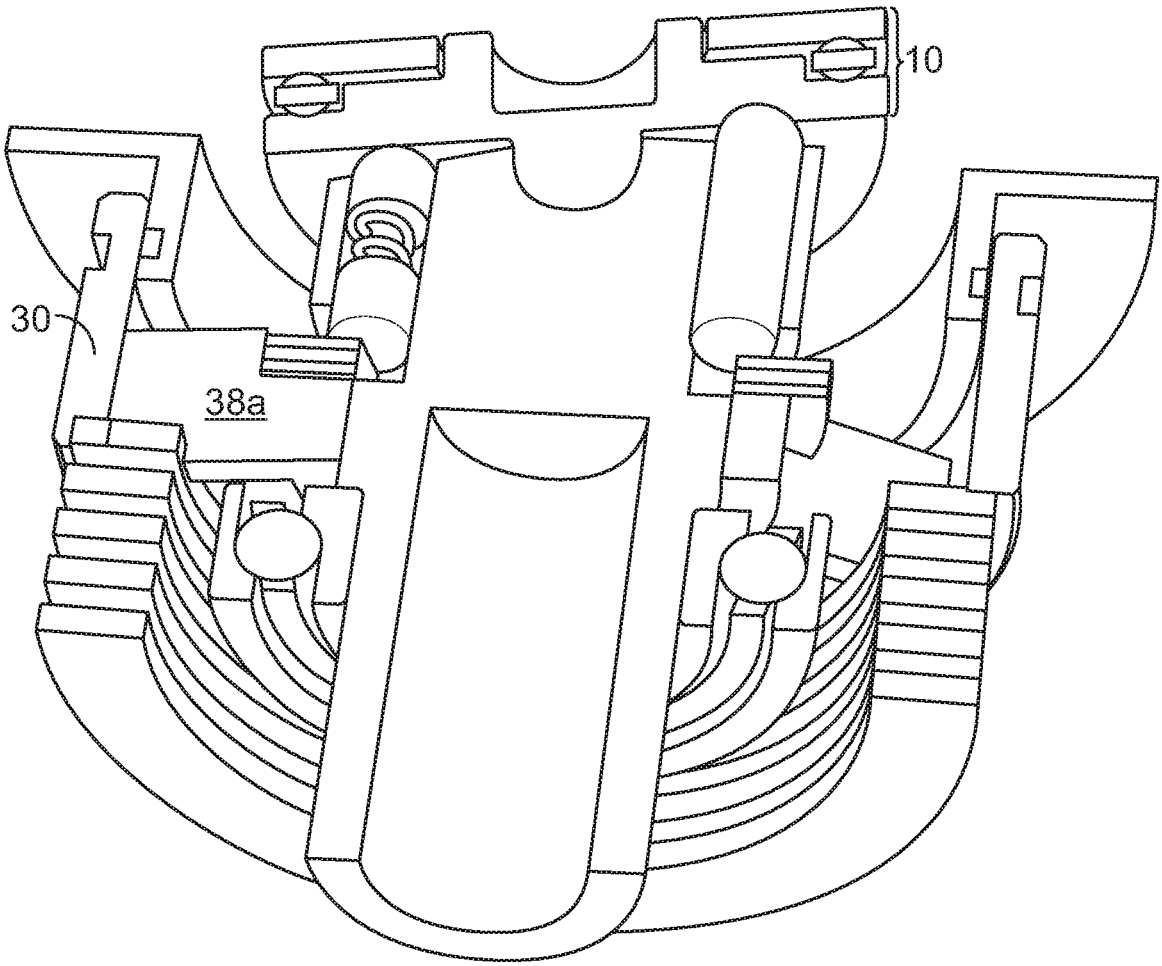
FIG. 10 diagrammatically depicts a cross-sectional view of a portion of the variable flow pump according to the first illustrative example embodiment.
Figure 11:
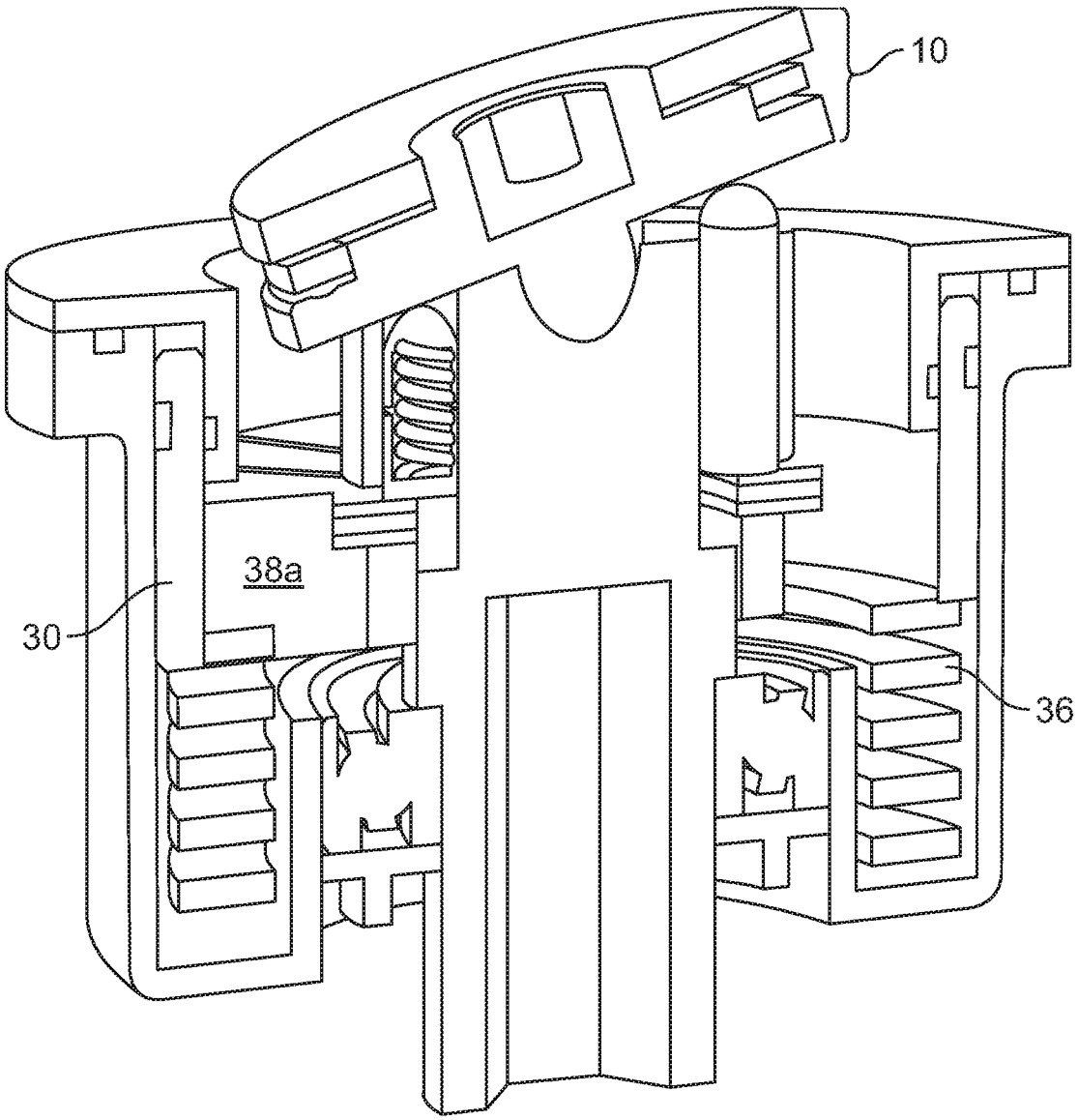
FIG. 11 depicts a cross-sectional view of a portion of the variable flow pump according to the first illustrative example embodiment.
Figure 12:
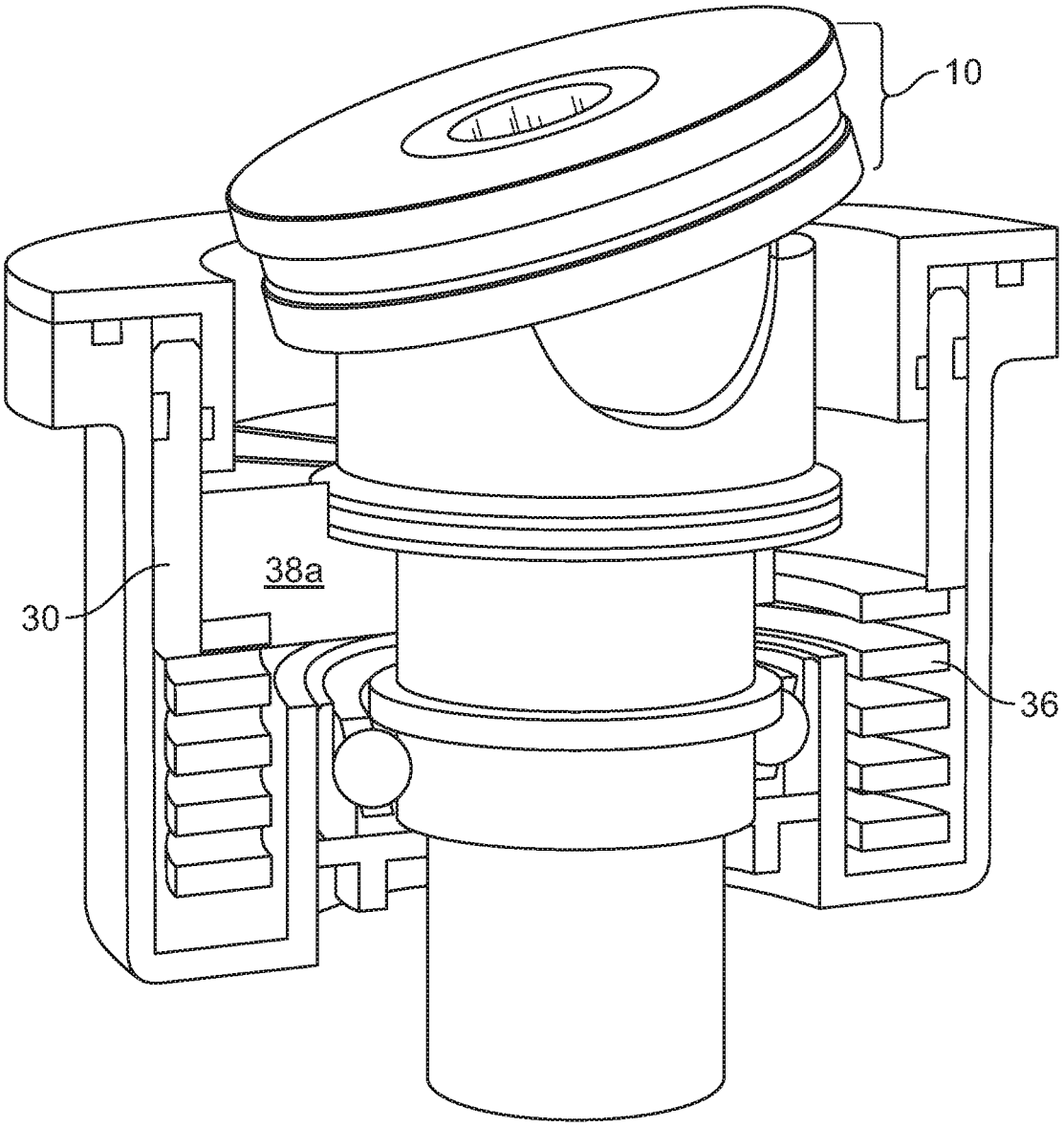
FIG. 12 depicts a partial cross-sectional view of a portion of the variable flow pump according to the first illustrative example embodiment.
Figure 13:
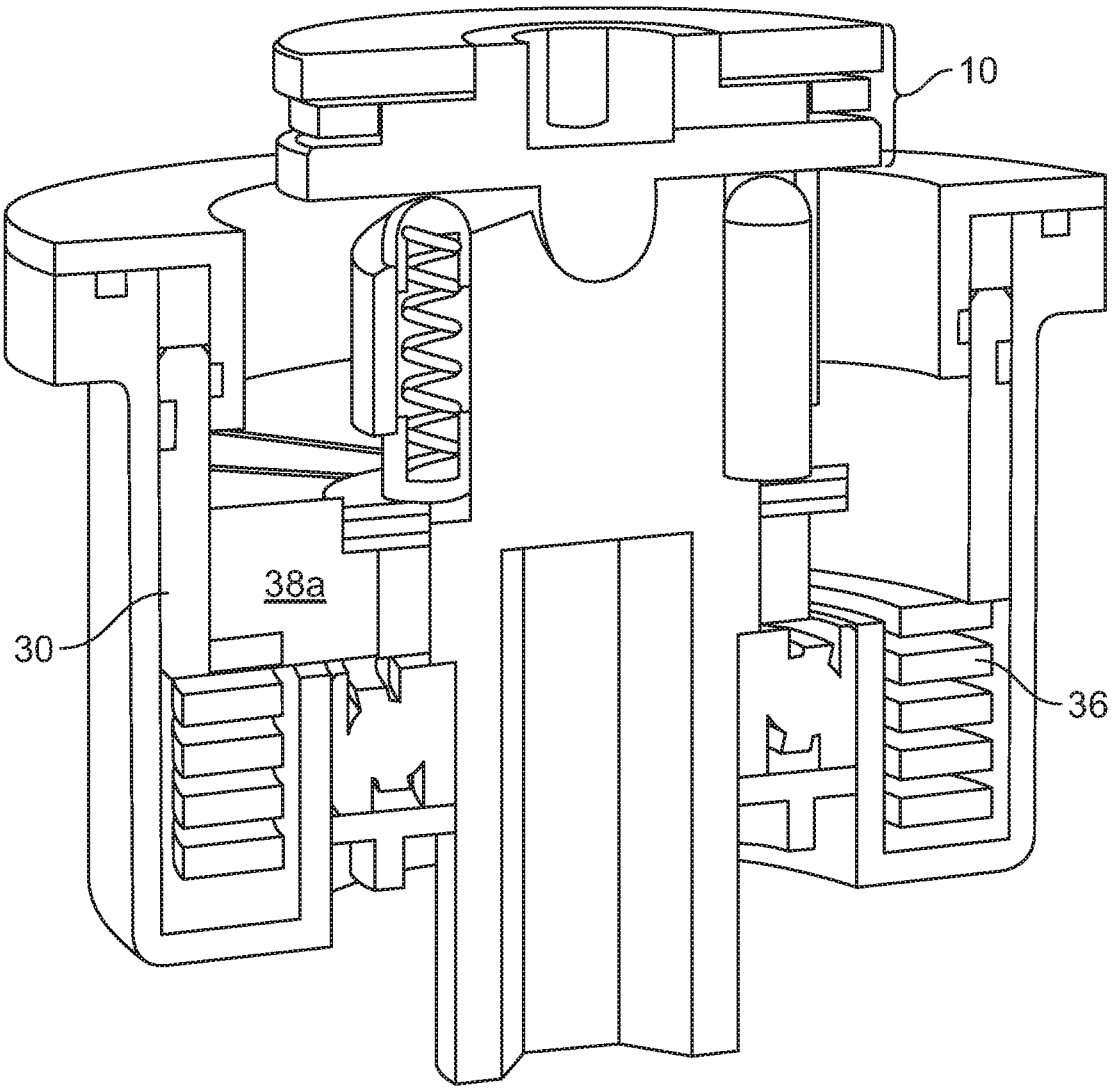
FIG. 13 depicts a cross-sectional view of a portion of the variable flow pump according to the first illustrative example embodiment.
Figure 14:
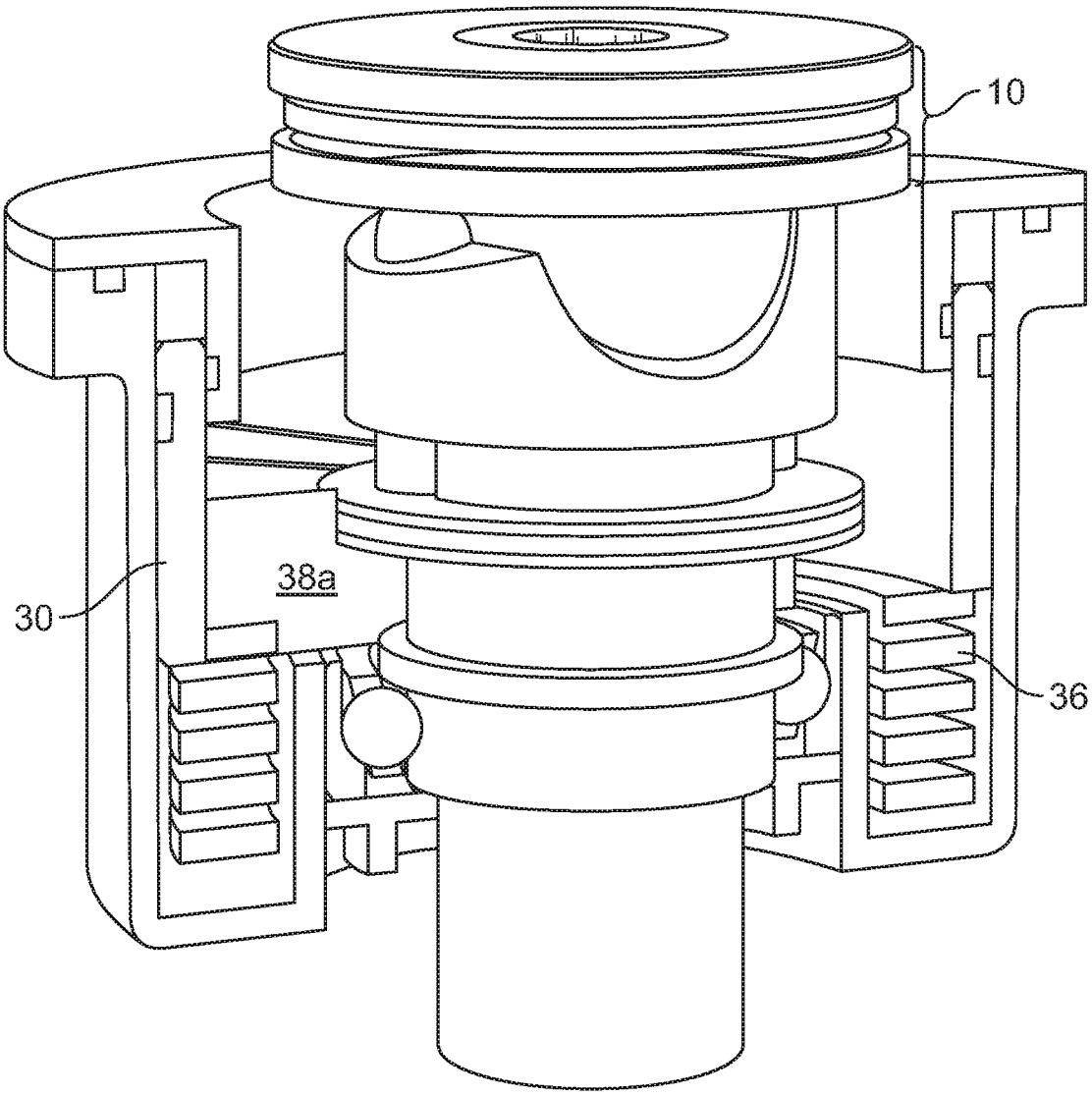
FIG. 14 diagrammatically depicts a partial cross-sectional view of a portion of the variable flow pump according to the first illustrative example embodiment.
Figure 15:
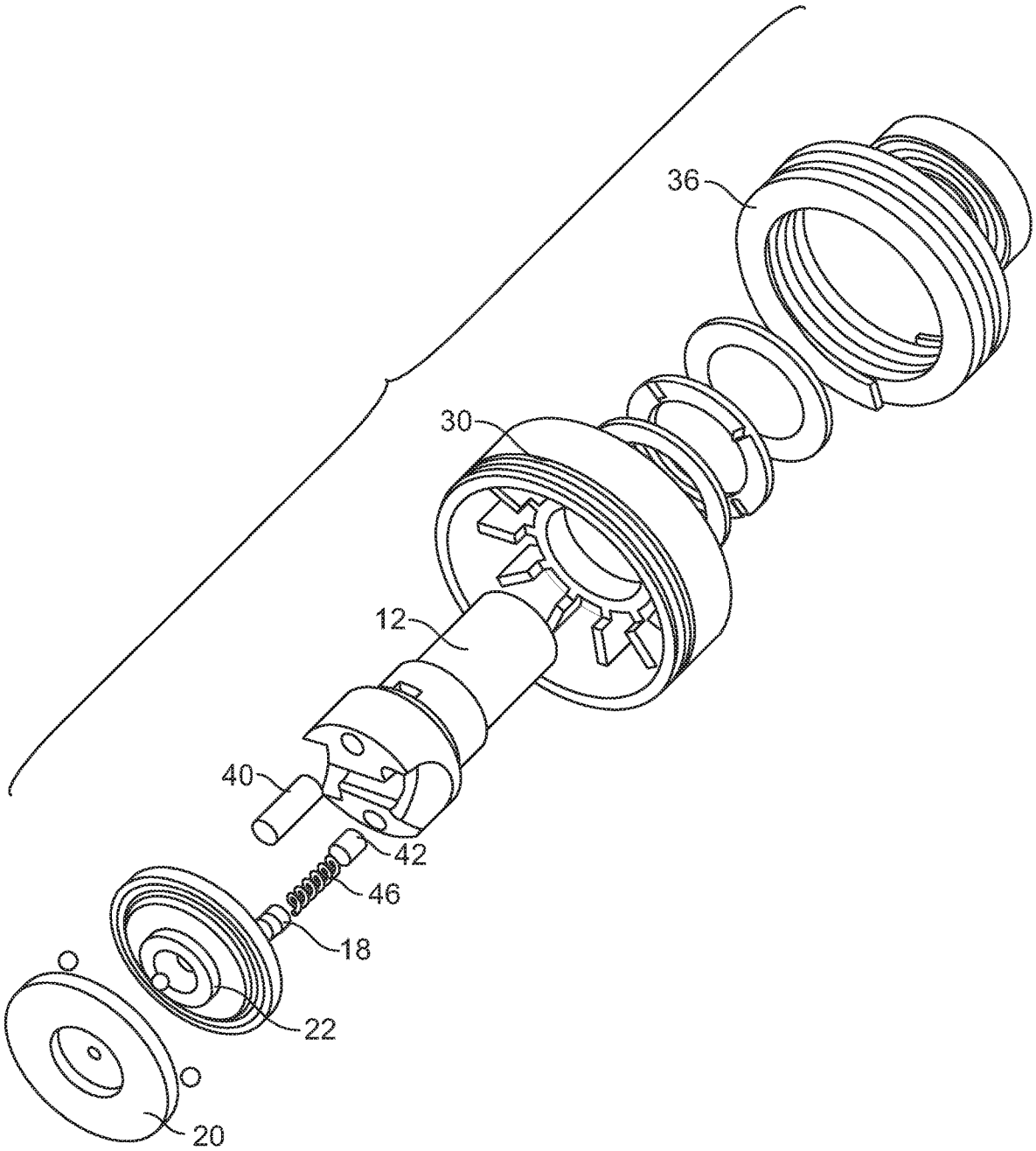
FIG. 15 diagrammatically depicts an exploded view of a portion of the variable flow pump according to the first illustrative example embodiment.
Figure 16:
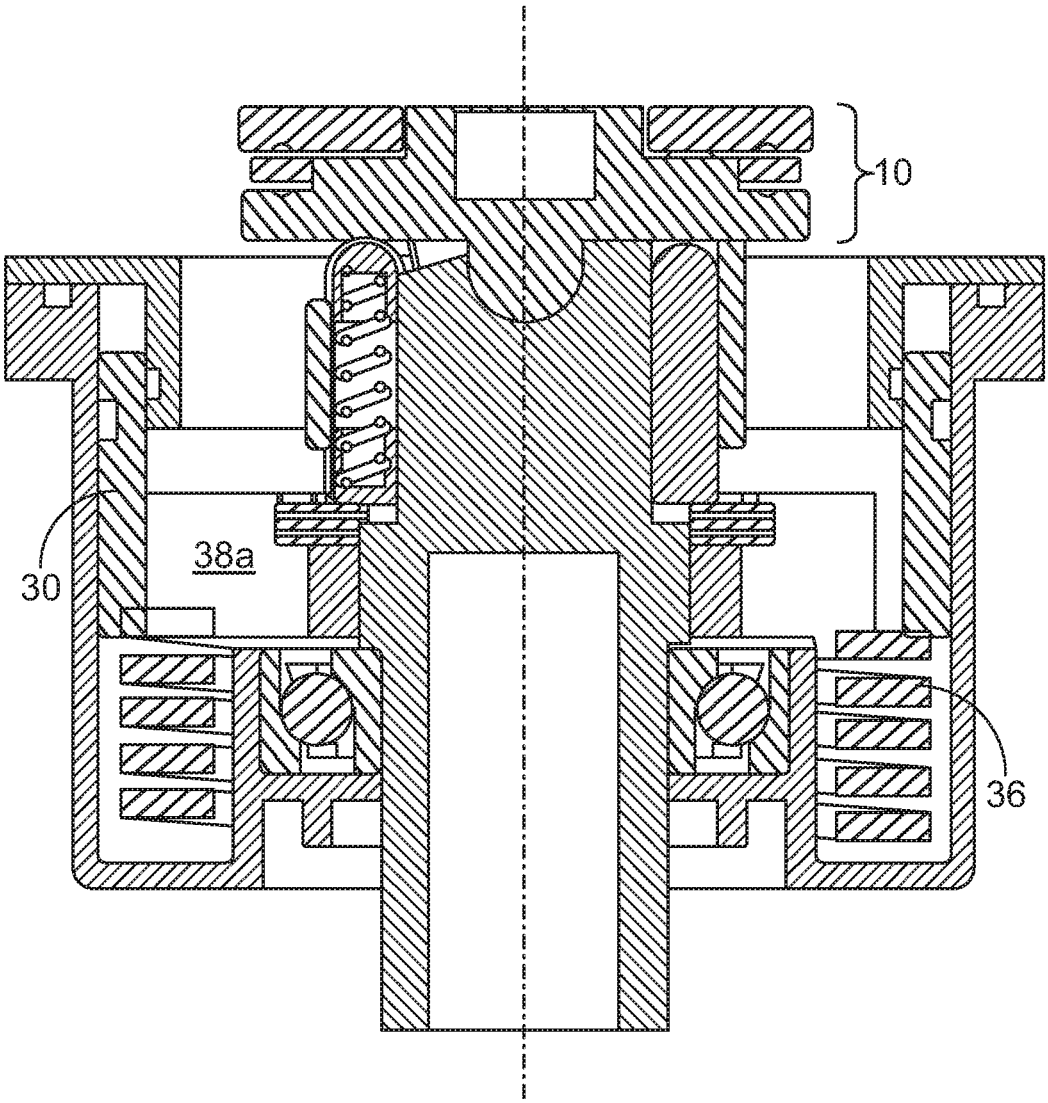
FIG. 16 diagrammatically depicts a cross-sectional view of a portion of the variable flow pump according to the first illustrative example embodiment.

In an embodiment, the angle of the swashplate 10 relative to the driveshaft 12 (i.e., the angle of the swashplate from an orientation that is perpendicular to the axis of the driveshaft) may be varied based upon, at least in part, backpressure of the pumped fluid at a location downstream from the outlet of the piston pump 14. In an embodiment in which the variable flow rate pump may be utilized in connection with a pressure washer, the angle of the swashplate 10 relative to the driveshaft 12 may be based upon, at least in part, backpressure of the pumped water at a location between the outlet of the piston pump 14 and the nozzle (not shown) of the pressure washer. In an example embodiment, as shown in FIG. 1, for example, a relatively high backpressure may result in the a relatively smaller swashplate angle (e.g., relative to an orientation generally perpendicular to the rotational axis of the driveshaft), which may include the first tilt angle. Further, in such an example embodiment, and as shown in FIG. 2, for example, a relatively smaller backpressure may result in a relatively larger swashplate angle, which may include the second tilt angle. As discussed above, in an example embodiment, a relatively smaller swashplate angle may result in a relatively shorter stroke of the piston pump 14 and a relatively smaller per-cycle pumping volume. Correspondingly, a relatively larger swashplate angle may result in a relatively longer stroke of the piston pump 14 and a relatively larger per-cycle pumping volume. The smaller and larger per-cycle pumping volume may generally correlate to a smaller and larger flow rate, respectively, for a given rotational speed of the driveshaft 12.

The variable flow pump may include an actuator piston that may be moveable between a first position and a second position based upon, at least in part, the backpressure of the fluid pumped by the piston pump at a location downstream from the piston pump. Consistent with the illustrated example embodiment, the variable flow rate pump may include an actuator piston in the form of an annular cylinder 28 that is defined around the rotational axis of the swashplate 10 and the driveshaft 12 (e.g., around the longitudinal axis of the driveshaft). While in the illustrated embodiment the annular cylinder 28 generally surrounds at least a portion of the swashplate 10 and the driveshaft 12, it will be appreciated that, depending upon the configuration of the variable flow rate pump, the annular cylinder may be located above (in an axial direction) the swashplate 10 and/or the driveshaft 12. An annular piston 30 may be configured to be at least partially received within the annular cylinder 28. In some embodiments, one or more of the annular cylinder 28 and the annular piston 30 may include seals (e.g., seals 32, 34), which may generally allow the annular piston 30 to sealingly engage with the annular cylinder 28.

The annular cylinder 28 may be in fluid communication with the pumped fluid at a location downstream from the piston pump 14, e.g., via port 48. As such, a fluid pressure within the annular cylinder 28 (e.g., within a chamber defined between the annular cylinder 28 and the annular piston 30) may be based upon, at least in part, a backpressure created by the pumped fluid. For example, the annular cylinder 28 may include a port, fluid line/pipe, etc. (generally designated as port 48, which may include a hole formed within the pump body, a separate fluid line or tube, or any combination of feature for providing fluid communication), which may be in fluid communication with a hose or pipe that contains the pumped fluid. As discussed above, in an embodiment in which the variable flow rate pump may be utilized in connection with a pressure washer, the annular cylinder 28 may be in fluid communication with the pumped water at a point between the piston pump 14 and a nozzle of the pressure washer. Accordingly, the pressure within the annular cylinder 28 (e.g., within the chamber defined between the annular cylinder 28 and the annular piston 30)

may be based upon, at least in part, the backpressure within the fluid line between the piston pump 14 and the nozzle of the pressure washer. The pressure within the annular cylinder 28 may exert a force against the annular piston 30 in a direction generally along the axis of the annular piston 30 (e.g., which may be generally coaxial with, and/or parallel to, the rotational axis of the swashplate 10 and the driveshaft 12). In the context of the illustrated example embodiment, the force exerted on the annular piston 30 may bias to annular piston 30 for movement in an axial direction away from the swashplate 10. As such, the annular piston may be moveable between a first position (e.g., which may include an extended position based upon, at least in part, a relatively higher backpressure of the pumped fluid) and a second position (e.g., a retracted position based upon a relatively lower backpressure of the pumped fluid).

The variable flow pump may further include an actuator assembly that may be moveable between a first position and a second position based upon, at least in part, the position of the actuator piston. As shown in the illustrated embodiment, the actuator piston (e.g., annular piston 30) may be provided as part of, and/or coupled to, the actuator assembly. Further, the actuator assembly may include a biasing member biasing the actuator assembly toward the second position (e.g., which may include a retracted position of the actuator piston, in an example embodiment). For example, and with continued reference to the drawings, the variable flow rate pump may include a mainspring 36, which may exert a biasing force on the annular piston 30, e.g., in a direction which may tend to decrease the volume of the chamber defined between the annular cylinder 28 and the annular piston 30. As shown in the illustrated example embodiment, the mainspring may be generally disposed around the longitudinal axis of the driveshaft. For example, the mainspring 36 may bear against at least a portion of an actuator body. In the illustrated embodiment, the actuator body may include at least a portion of the annular piston 30. In such a configuration, the mainspring 36 may bear against a bottom surface of the annular piston 30 (and/or against one or more actuator assembly components that may interact with the annular piston). In the illustrated example embodiment, the actuator body of the actuator assembly (which may include, and/or be coupled with, the annular piston 30) may additionally include a plurality of radially inwardly projecting fins (e.g., fins 38*a* and 38*b*). The inwardly projecting fins may be integrally formed with the annular piston 30, and/or may include one or more separate components that may be coupled with the annular piston 30, e.g., allowing for axial movement of the fins with the annular piston. In such an embodiment, the inwardly projecting fins and/or at least a portion of the annular piston may form at least a portion of the actuator body of the actuator assembly. It will be appreciated that features other than radially extending fins may be similarly utilized. The mainspring 36 may bear against a portion of the fins and/or at least a portion of the lower edge of the annular piston 30, thereby providing the biasing force against the annular piston 30.

As described above, pressurized fluid within the annular cylinder 28, which may result from the backpressure within the hose of tube conveying the fluid pumped by the piston pump 14, may exert a force against the annular piston 30 urging the annular piston 30 away from the annular cylinder 28. The force exerted by the pressurized fluid within the annular cylinder 28 may be countered, at least in part, by the biasing force of the mainspring 36. Accordingly, the height of the annular piston 30 relative to the swashplate 10 may be based upon, at least in part, the pressure of the pressurized fluid within the annular cylinder 28, and the degree to which that pressure is countered by the biasing force of the mainspring 36. As such, a relatively higher backpressure within the hose of tube conveying the fluid pumped by the piston pump 14 may result in a relatively higher pressure within the annular cylinder 28. The relatively higher pressure within the annular cylinder 28 may exert a relatively larger force against the annular piston 30, which may compress the mainspring 36 a to achieve a first height of the annular piston relative to the swashplate 10. In a similar manner, a relatively lower backpressure within the hose or line conveying the fluid pumped by the piston pump 14 may result in a relatively lower pressure within the annular cylinder 28. The relatively lower pressure within the annular cylinder 28 may exert a relatively lower force against the annular piston, which may compress the mainspring 36 less than the relatively higher back pressure. As such, the annular piston 30 may achieve a second height relative to the swashplate 10. Consistent with the illustrated embodiment, the first height (e.g., as shown in FIG. 1) may be lower relatively to the swashplate 10 than the second height (e.g., as shown in FIG. 2).

As described above, the height of the annular piston 30 may be based upon, at least in part, the pressure within the annular cylinder 28, which may be based upon, at least in part, the backpressure within the hose or line conveying the pumped fluid from the piston pump 14. The annular piston 30 may act against the swashplate 10 to vary the angle of the swashplate 10 based upon, at least in part, the height of the annular piston 30. For example, one or more actuator drivers may mechanically couple at least a portion of the actuator assembly (e.g., which may, in various embodiments, include the actuator body, including one or more of the annular piston 30, the radially inwardly projecting fins, and/or other features) with at least a portion of the swashplate 10. In the illustrated example embodiment, two generally radially opposed actuator driver pins (e.g., pins 40, 42) may extend between the annular piston 30 and the swashplate 10. It will be appreciated that while two actuator driver pins are depicted, other numbers of actuator driver pins may be utilized. Further, it will also be appreciated that while the actuator driver pins are shown located on radially opposed sides of the driveshaft 12, other configurations may be utilized. As shown, the actuator driver pins 40, 42 may be radially disposed around the driveshaft 12 to be positioned generally perpendicularly to the axis of the pivot 24.

Consistent with the illustrated example embodiment, a bearing 44 may be disposed on an upper surface of the fins (e.g., fins 38*a*, 38*b*) extending radially inwardly from the annular piston 30. Further the two actuator driver pins 40, 42 may be disposed on an upper surface of the bearing 44, such that changes in the height of the annular piston 30 relative to the swashplate 10 may result in a change in the height of the driver pins 40, 42. The bearing 44 disposed between the fins associated with the annular piston 30 and the actuator driver pins 40, 42 may allow the actuator driver pins 40, 42 to rotate around the axis of the driveshaft 12 independently from the annular piston 30. For example, the annular piston 30 may remain rotationally stationary, while the actuator driver pins 40, 42 may rotate with the swashplate 10 and the driveshaft 12.

In an embodiment one of the actuator driver pins (e.g., actuator driver pin 40) may include a swashplate driver configured to urge the swashplate between the first tilt angle and the second tilt angle. Consistent with the illustrated embodiment, the swashplate driver may include a member having a fixed length for transmitting displacement between the actuator body (e.g., which may include one or more of the annular piston and the radially inwardly projecting fins) and the swashplate. As such, axial movement of the base of the swashplate driver pin 40 relative to the swashplate 10 (e.g., as a result of axial movement of the annular piston) may result in a generally corresponding degree of axial movement of the top nose of the swashplate driver pin 40. Additionally, consistent with the illustrated embodiment, the actuator assembly may also include a biasing driver configured to apply a force urging the swashplate into contact with the swashplate driver pin. In an example embodiment, the other actuator driver pin 42 (i.e., the biasing driver) may include an expandable member (e.g., a variable length pin) disposed between the actuator body and the swashplate. For example, the variable length biasing driver pin 42 may include a spring-loaded pin, in which the length of the biasing driver pin 42 is variable based upon, at least in part, the compression and expansion of a spring 46 disposed between a base and a top nose of the variable length biasing driver pin 42. Consistent with the foregoing arrangement, the fixed length swashplate driver pin 40 may contact a first side of the swashplate 10 relative to the axis of the swashplate pivot 26, and the variable length biasing driver pin 42 may bear on a second, generally opposed, side of the swashplate 10 relative to the swashplate pivot. The expansion force of the spring 46 within the variable length biasing driver pin 42 may cause the top nose of the biasing driver pin 42 to pivotally urge the swashplate 10 into contact with the top nose of the fixed length swashplate driver pin 40. As such, the variable length biasing driver pin 42 may facilitate contact between the swashplate 10 and the fixed length swashplate driver pin 40.

With particular reference to, for example, FIG. 1, when the pressure within the annular cylinder 28 is relatively high, the annular piston 30 may be at the first height, which may be relatively extended from the annular cylinder and withdrawn away from the swashplate 10, e.g., as a result of the pressure within the annular cylinder 28 overcoming a relatively large amount of the counter force from the mainspring 36. Correspondingly, the nose of the fixed length swashplate driver pin 40 may be at a height that may allow the swashplate 10 to achieve a relatively small angle, e.g., such that the swashplate 10 may be approximately perpendicular to the driveshaft 12. In an embodiment, a biasing force applied by the variable length biasing driver pin 42 may urge the swashplate 10 toward the relatively small angle. In one embodiment, the relatively high pressure within the annular cylinder may be the result of the trigger valve of the pressure washer being closed, thereby preventing flow of the pumped fluid through the system. As generally discussed above, in an embodiment, the relatively small angle of the swashplate 10 may result in a relatively small stroke (e.g., relatively small reciprocating displacement) of the piston plunger 28 (e.g., which may include nominally no stroke of the piston plunger), and a relatively small attempted pumping volume by the piston pump 14. In an embodiment, the relatively small pumping volume (e.g., including nominally zero pumping volume) when the trigger valve of the pressure washer is close may reduce stress on the system. For example, the piston pump may generally include a positive displacement pump. However, when the trigger valve is closed, no water may exit the system, placing a possibly significant amount of stress on the pump components as the pump is forced to act against the closed system.

Referring also to, for example, FIG. 2, when the pressure within the annular cylinder 28 is relatively low, the annular piston 30 may be at the second height, which may be relatively retracted within the annular cylinder 28, and thereby the base of the annular piston may be relatively extended upwardly (in the depiction of the figures) relative to the swashplate 10, e.g., as a result of the relatively lower pressure within the annular cylinder 28 overcoming a relatively smaller amount of the counter force from the mainspring 36. When the annular piston 30 is at the second height, which may be relatively extended upwardly relative to the swashplate 10, the nose of the fixed length swashplate driver pin 40 may also be at a relatively extended height. The relatively extended height of the fixed length swashplate driver pin 40 may urge the swashplate 10 into a second, relatively larger tilt angle. The larger tilt angle of the swashplate 10 may cause the swashplate 10 to bear against the variable length biasing driver pin 42, which may compress the spring 46 within the biasing driver pin 42 allowing the biasing driver pin 42 to achieve a relatively shorter length. The resulting larger angle of the swashplate 10 may result in a relatively greater stroke length (i.e., reciprocating displacement) of the piston plunger 16, which may correspondingly result in a greater pumped volume per pump cycle (e.g., per rotation of the swashplate 10). In an embodiment, the relatively low pressure within the annular cylinder 28 may result from a relatively lower backpressure within the hose between the piston pump 14 and the nozzle of a pressure washer. For example, when the trigger valve of the pressure was is opened (e.g., in response to the pressure washer trigger being pulled), the backpressure within the hose may decrease, resulting in a corresponding decrease in the pressure within the annular cylinder 28. The decrease in the pressure within the annular cylinder 28 may cause the swashplate 10 to achieve the larger angle, and thereby increase the pumping rate of the piston pump 14. In this manner, the pumping rate may increase when the pressure washer is in use (i.e., when the trigger is pulled), and may decrease when the pressure washer is not in use (i.e., when the trigger is not pulled).

It will be appreciated that, in addition to the changes in pumping rate resulting from the opening and closing of the trigger valve, the pumping rate may also be influenced by varying the speed of rotation of the swashplate 10 and driveshaft 12. For example, appropriate control systems may be implemented to increase the speed of the prime mover (and therein the speed of the swashplate 10 and the driveshaft 12) when the pressure washer is in use, and to decrease the speed of the prime mover when the pressure washer is not in use. Example of such control systems may include sensors to detect when the trigger is pulled, sensors to detect the relative back pressure within system, etc.

In addition/as an alternative to varying the pumping rate of the piston pump 14 depending upon whether the pressure washer is in use, the variable flow rate pump may also be implemented to achieve different pumping flow rates when different nozzles are utilized. For example, pressure washers may include interchangeable nozzles that may provide different output pressures that may be suitable for accomplishing different tasks. For example, a relatively smaller diameter nozzle orifice may provide a higher pressure output stream, while a relatively larger diameter nozzle orifice may provide a lower pressure output stream. It will be appreciated that the flow rate demands associated with a relatively smaller diameter nozzle (e.g., a high pressure nozzle) may be less than the flow rate demands associated with a relatively larger diameter nozzle (e.g., a lower pressure nozzle). Consistent with an embodiment, the variable flow rate pump may be capable of achieving a desired flow rate based upon a nozzle that is current being used. Further, the variable flow rate pump may be capable of changing to a new desired flow rate when the nozzle is changed without requiring any changes to the pump.

For example, and as described above, the angle of the swashplate 10 may be varied based upon, at least in part, the backpressure between the nozzle and the piston pump 14. That is, the backpressure may change the pressure within the annular cylinder 28, and therein the force exerted on the annular piston 30. The force exerted on the annular piston 30 may result in the achieved height of the annular piston 30 relative to the swashplate 10, based upon, at least in part, the degree of compression of the countering mainspring 36. Because a relatively small nozzle diameter (e.g., which may be associated with a high pressure output stream) may result in a relatively high backpressure and relatively high pressure within the annular cylinder 28, the swashplate 10 may achieve a relatively small tilt angle. The relatively small tilt angle may result in a relatively low pumping rate. A relatively large nozzle (e.g., which may be associated with a relatively low pressure output stream) may result in lower backpressure, and therefore less pressure within the annular cylinder. Therefore, the swashplate 10 may achieve a relatively large tilt angle. The relatively large tilt angle may result in a relatively high pumping rate. It will be appreciated that the swashplate may be capable of achieving a wide variety of tilt angles, and corresponding pumping rates, depending upon the backpressure created by the nozzle being utilized. As such, the variable flow rate pump may be suitably utilized with a multitude of different nozzles sizes and configurations, and may provide differing flow rates for each of the different nozzles. Further, the variable flow rate pump may be utilized in connection other flow restriction devices on the output of the pump and/or pressure washer, in addition/as an alternative to different discrete nozzles. For example, the variable flow rate pump may be used in connection with a metering valve, or variable size/adjustable nozzle, in which a single nozzle/valve may be utilized to achieve different output flow characteristics.

In an embodiment, the tilt angles achievable by the swashplate 10 may be constrained, e.g., by driveshaft profiles 48, 50 (e.g., which may be best observed in FIGS. 8, 9, and 13-14) on either side of the pivot recess 26. For example, the angles surface of driveshaft profile 48 may constrain the maximum tilt angle of the swashplate 10, e.g., by preventing additional pivoting of the swashplate. Similarly, the driveshaft profile 50 may be generally perpendicular to the axis of the driveshaft 12 such that the swashplate 10 may achieve a minimum tilt angle perpendicular to the driveshaft 12. It will be appreciated that other configurations may be implemented depending upon design criteria and need. For example, in addition/as an alternative to different driveshaft profiles, other features may be utilized for controlling the range of achievable tilt angles of the swashplate, including, but not limited to, stops or projections associated with the driveshaft, the swashplate, the actuator assembly, and/or a housing of the variable flow pump. Further, the swashplate 10 may be configured to have a completely variable tilt angle (e.g., within any constraints that may be provided by the driveshaft profiles 48, 50, or other tilt-angle constraining features). In some embodiments, the swashplate 10 may be configured to have specific pre-set indexed positions to accomplish specific tasks, like high pressure/low flow for washing, medium pressure and flow for applying soap and low pressure/high flow for rinsing.

Figure 17:
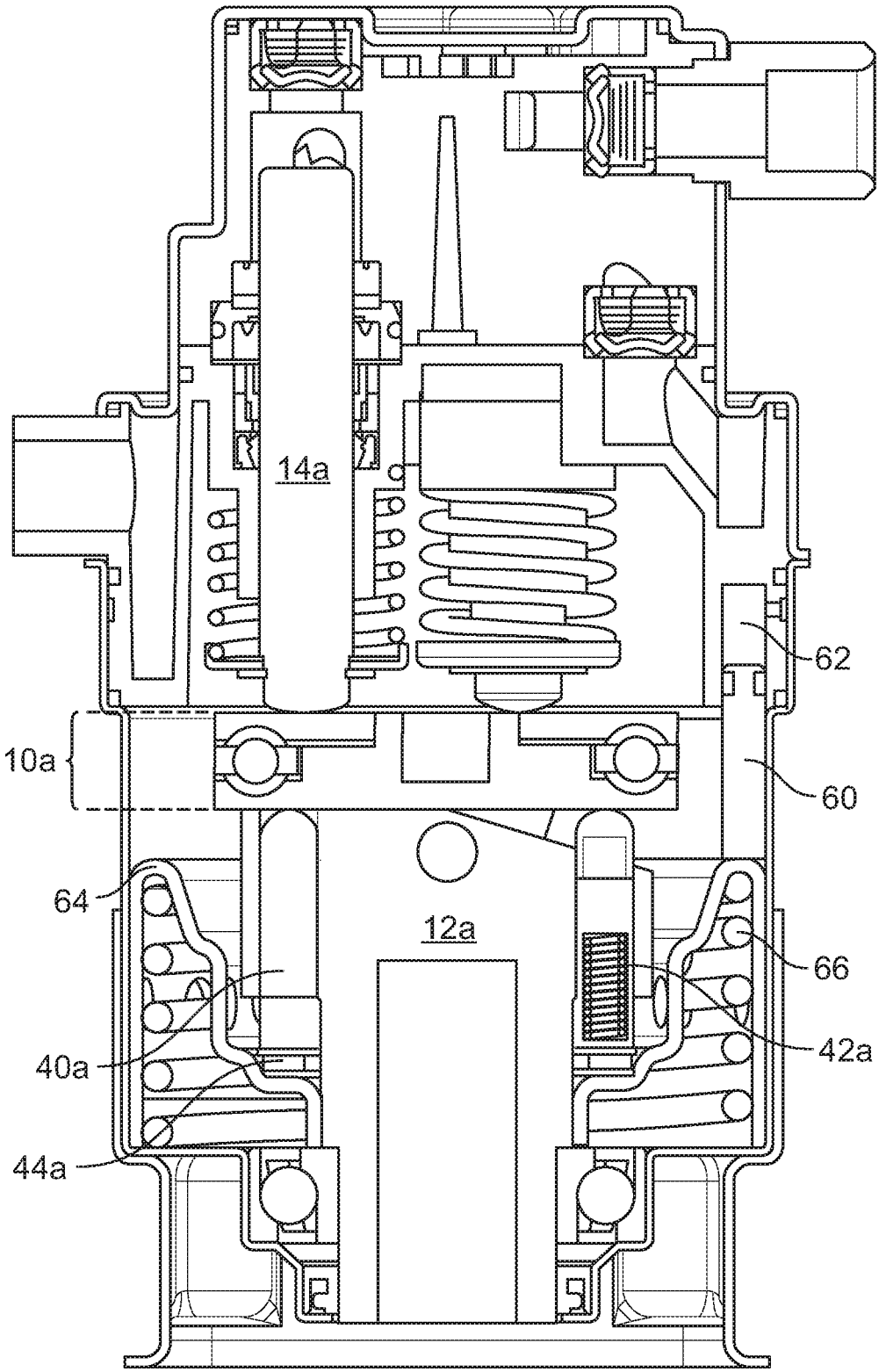
FIG. 17 diagrammatically depicts a variable flow pump according to a second illustrative example embodiment.
Figure 18:
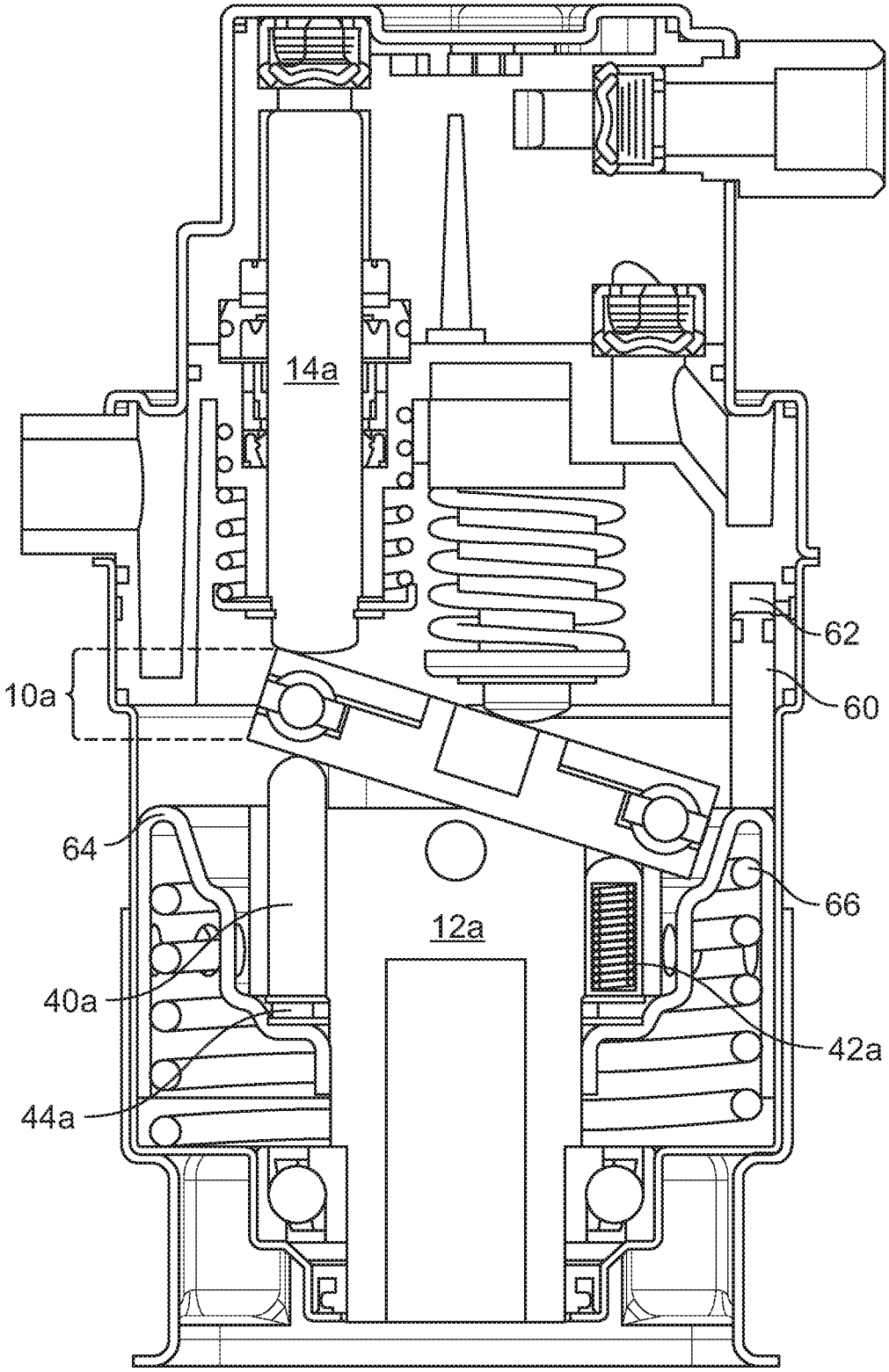
FIG. 18 diagrammatically depicts the variable flow pump according to the second illustrative example embodiment.
Figure 19:
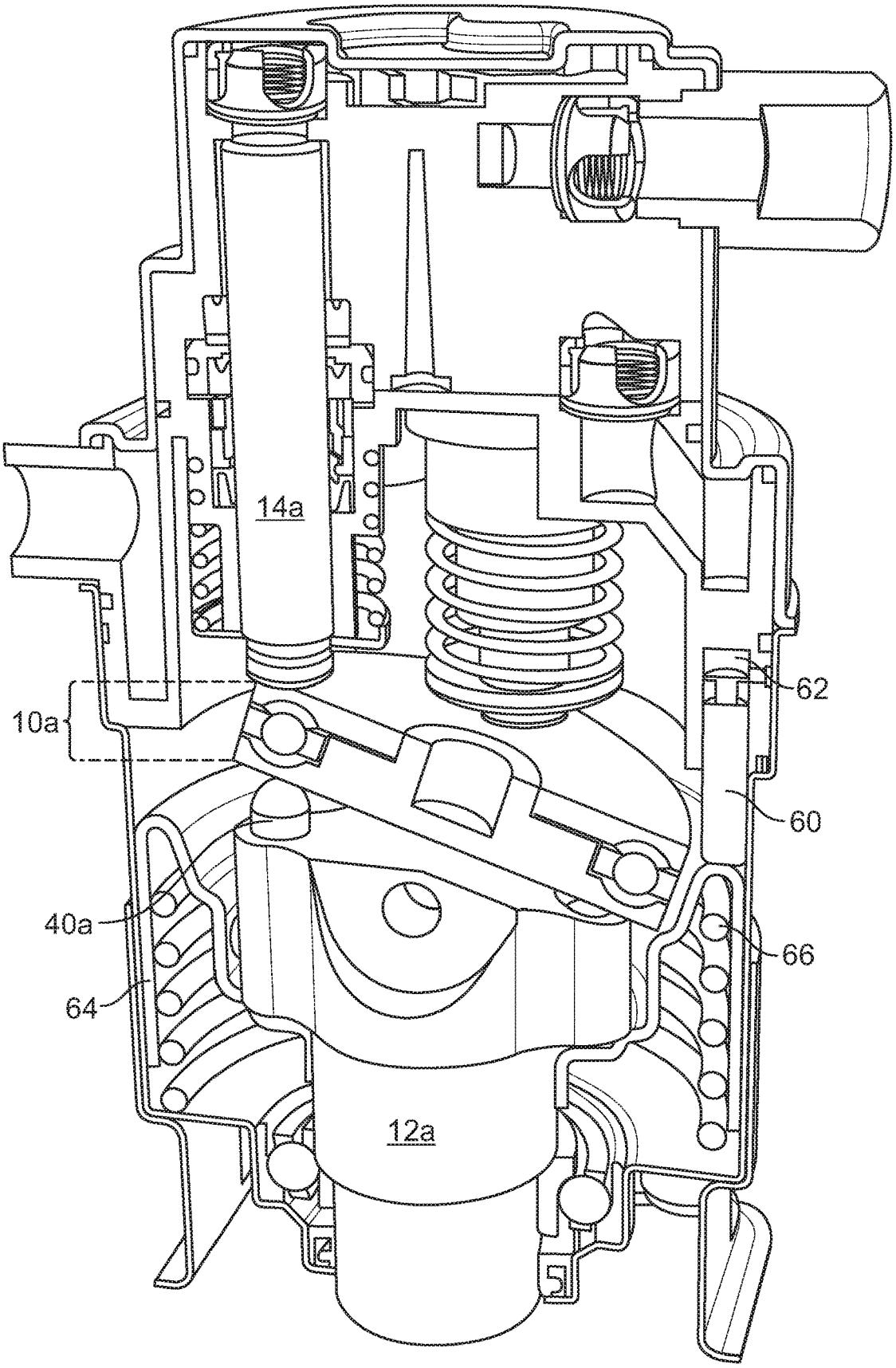
FIG. 19 diagrammatically depicts a partial perspective cross-sectional view of the variable flow pump according to the second illustrative example embodiment.
Figure 20:
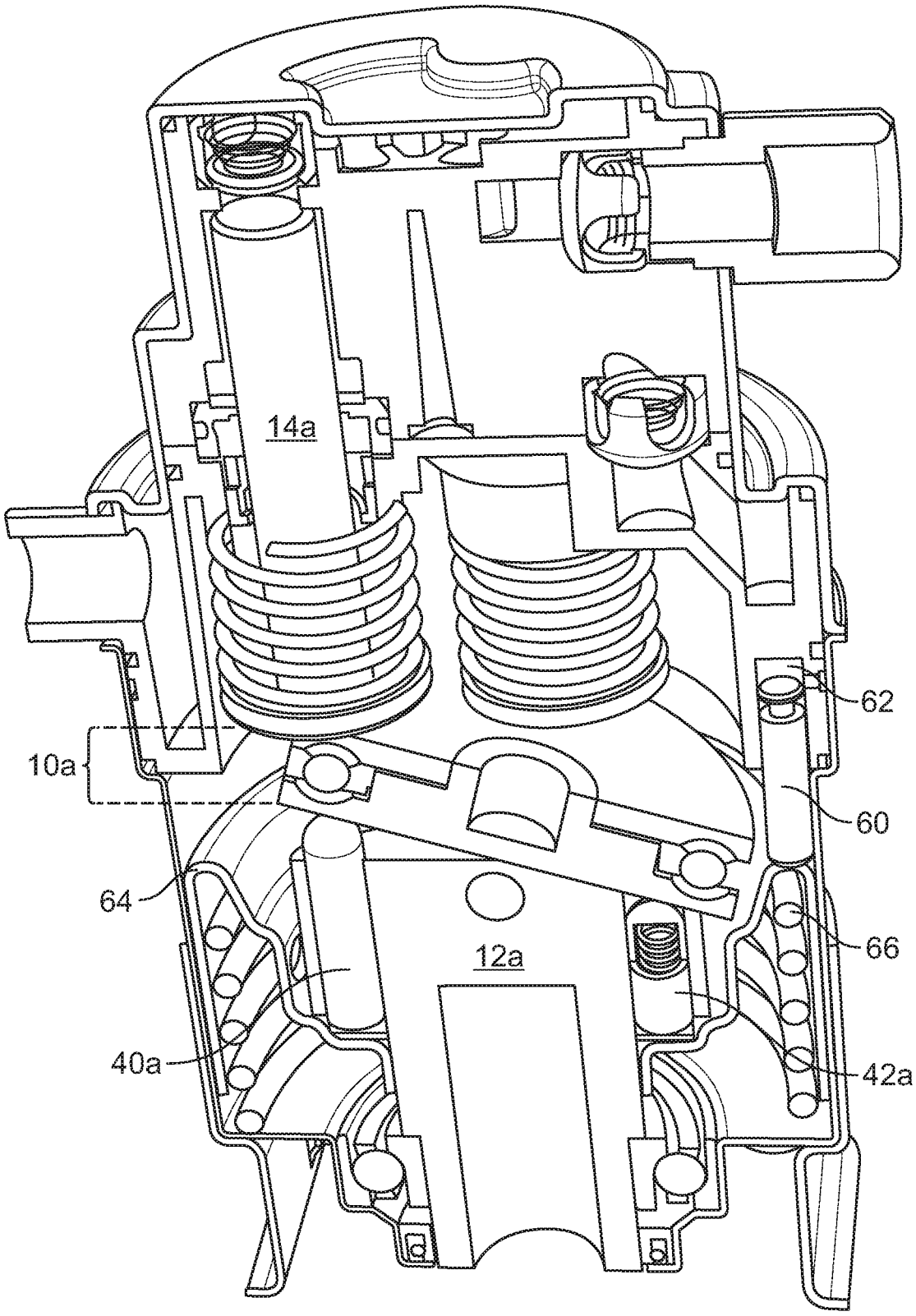
FIG. 20 depicts a partial perspective cross-sectional view of the variable flow pump according to the second illustrative example embodiment.

Referring also to FIGS. 17 through 20, another example embodiment of a variable flow pump consistent with the present disclosure is shown. As generally described above, the variable flow pump may generally include a swashplate (e.g., swashplate 10*a*). The swashplate 10*a* may be coupled with a driveshaft (e.g., driveshaft 12*a*). The swashplate 10*a* and the driveshaft 12*a* may be coupled such that the swashplate 10*a* may be rotatably driven by the driveshaft 12*a*. As also discussed above, the swashplate 10*a* may be moveable between a first tilt angle (e.g., as generally shown in FIG. 17) and a second tilt angle (e.g., as generally shown in FIG. 18) relative to the driveshaft 12*a*. One or more piston pumps (e.g., piston pump 14*a*) may interact with the swashplate 10*a* for being reciprocatingly driven based upon, at least in part, the tilt angle of the swashplate 10*a* relative to the driveshaft 12*a*. As described above, various interfacing features may be utilized, e.g., for reducing friction between the swashplate 10*a* and the piston pump 14*a*.

Consistent with the illustrated embodiment, the variable flow pump may additionally include an actuator coupled with the swashplate 10*a* for moving the swashplate 10*a* between first tilt angle and the second tilt angle based upon, at least in part, a downstream pressure of a fluid pumped by the piston pump 14*a*. For example, the actuator may include one or more actuator pistons (e.g., actuator piston 60). The actuator piston 60 may be received in a bore (e.g., bore 62) or cylinder, and may be moveable between a first position (e.g., as generally shown in FIG. 17) and a second position (e.g., as generally shown in FIG. 18). For example, the bore 62 may be fluidly coupled with the fluid pumped by piston pump 14*a* at a location downstream of the piston pump 14*a*. As such, the fluid pressure within the bore 62 (e.g., in the chamber formed by actuator the piston 60 and the bore 62) may be generally based upon a backpressure of the fluid system downstream from the piston pump 14*a*. As such, when the backpressure within the fluid system downstream from the piston pump 14*a* is relatively higher, the actuator piston 60 may be urged toward a first position, e.g., which may be relatively extended relative to the bore 62. Similarly, when the backpressure within the fluid system downstream from the piston pump 14*a* is relatively lower, the actuator piston 60 may be urged toward a second position, e.g., which may be relatively retracted relative to the bore 62. While only a single actuator piston is shown in FIGS. 17-20, it will be appreciated that more than one actuator piston may be utilized. In an example embodiment, a plurality of actuator pistons may be radially spaced around the swashplate 10*a* and/or the driveshaft 12*a*. For example, the plurality of actuator pistons may be radially spaced around the swashplate 10, such that each of the actuator pistons may be located radially beyond the periphery of the swashplate 10*a*. It will be appreciated that various additional and/or alternative embodiments may be implemented consistent with the foregoing description and the depicted embodiments.

As shown, in at least the first position the actuator piston(s) 60 may act against (either directly or indirectly via one or more intervening components) an actuator body 64. As such, based upon, at least in part, the position and/or movement of the actuator piston 60, the actuator body 64 may be moved between at least a first position relative to the swashplate 10*a* (e.g., as generally shown in FIG. 17) and a second position relative to the swashplate 10*a* (e.g., as generally shown in FIG. 18). The actuator may further include a biasing member, such as a coil spring 66. Consistent with the illustrated embodiment, the coil spring 66 may be disposed around at least a portion of the driveshaft 12*a*, and may urge the actuator body 64 toward the second position (e.g., as generally shown in FIG. 18). Accordingly to such an embodiment, when the actuator pistons 60 are in the first position, the actuator pistons 60 acting against the actuator body 64 may at least partially compress the coil spring 66. Further, in some embodiments, the coil spring 66, acting through the actuator body 64 may act against the actuator pistons 60 to urge the actuator pistons 60 toward the second position (e.g., when the downstream backpressure of the fluid system is relatively lower). In this manner, the position of the actuator body 64 and/or the actuator pistons 60 may be based upon, at least in part, the spring force of the coil spring 66 and/or the backpressure within the fluid system (e.g., which may exert a force against the actuator piston 60). Further, it will be appreciated that while the biasing member is depicted as a coil spring, various other configurations may be utilized, including, but not limited to, a plurality of individual biasing members, a hydraulic or pneumatic biasing member, a flat spring, etc., as well as various combinations of different biasing members.

As shown in the illustrated example, the actuator body 64 may generally include a hat or collar that may be configured to at least partially surround the driveshaft 12*a* and/or the swashplate 10*a*. Further, the actuator body 64 may be formed to at least partially contain or locate the biasing member. For example, as shown the actuator body may be formed to include an annular recess, e.g., which may receive at least a portion of the coil spring 66, which may locate and/or retain the coil spring. Further, the actuator body 64 may be configured to support one or more actuator drivers, such as a swashplate driver 40*a* and a biasing driver 42*a*. As generally described above, the swashplate driver 40*a* may act against the swashplate 10*a* for moving the swashplate 10*a* between the first tilt angle and the second tilt angle based upon, at least in part a position of the actuator body 64 (e.g., which position may be based upon, at least in part, a position of the actuator piston 60 that is based upon the backpressure within the fluid system and the spring force of the biasing member—coil spring 66). Further, and as also generally described above, the biasing driver 42*a* may generally urge the swashplate 10*a* into contact with the swashplate driver 40*a*. In some embodiments, and as also generally described above, the actuator may include a friction reducing feature, such as a bearing 44*a*, or other low friction interface, that may generally allow the actuator drivers to rotate independently of the actuator body 64 (e.g., such that the actuator drivers may remain in a generally consistent position relative to the swashplate 10*a* during rotation of the swashplate 10*a*). In an example embodiment, the actuator body 64 may be formed from a stamped sheet metal component, a molded component, or the like. In some situations, forming the actuator body 64 from a stamped sheet metal component may provide manufacturing economies.

Figure 21:
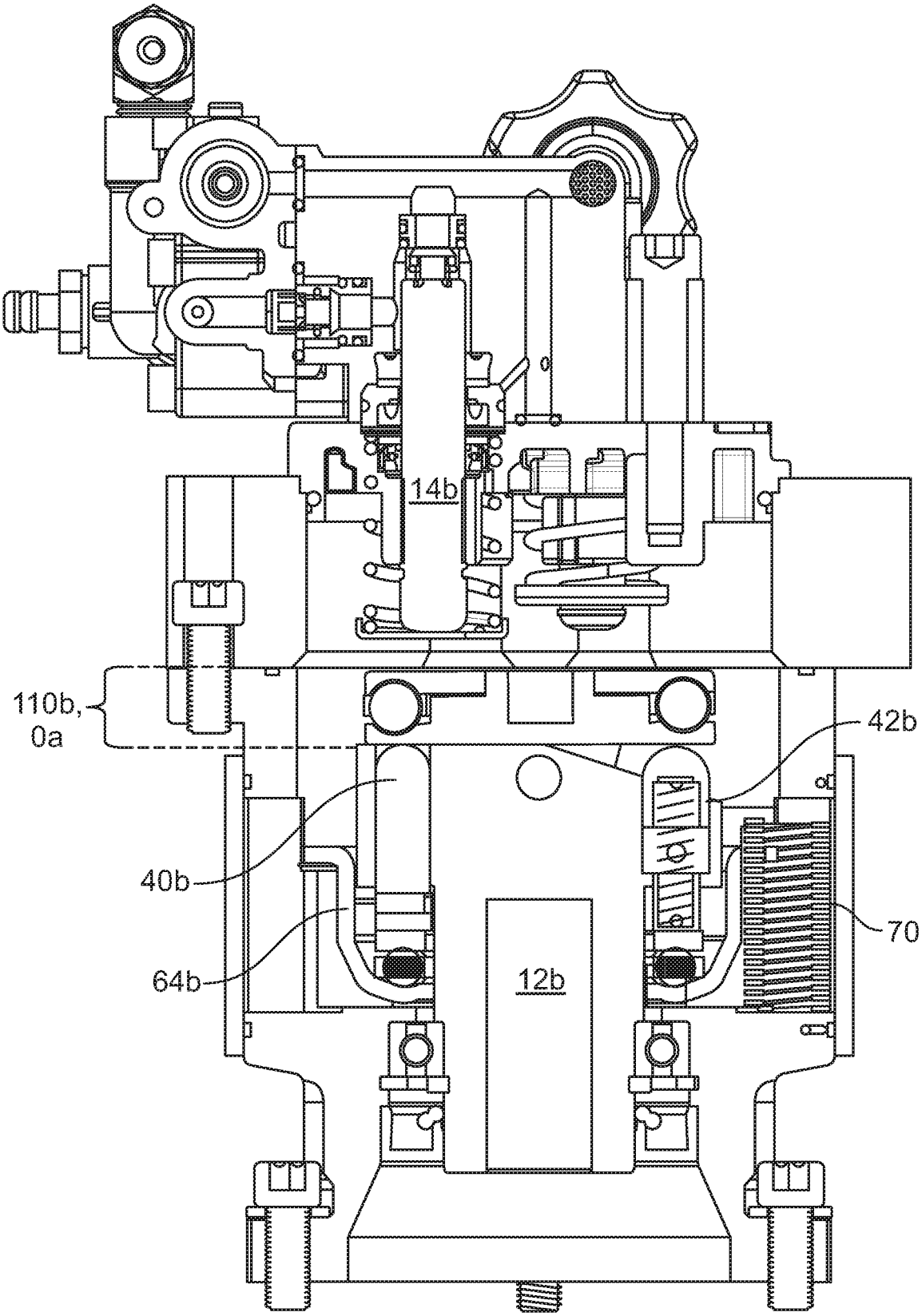
FIG. 21 diagrammatically depicts a variable flow pump according to a third illustrative example embodiment.
Figure 22:
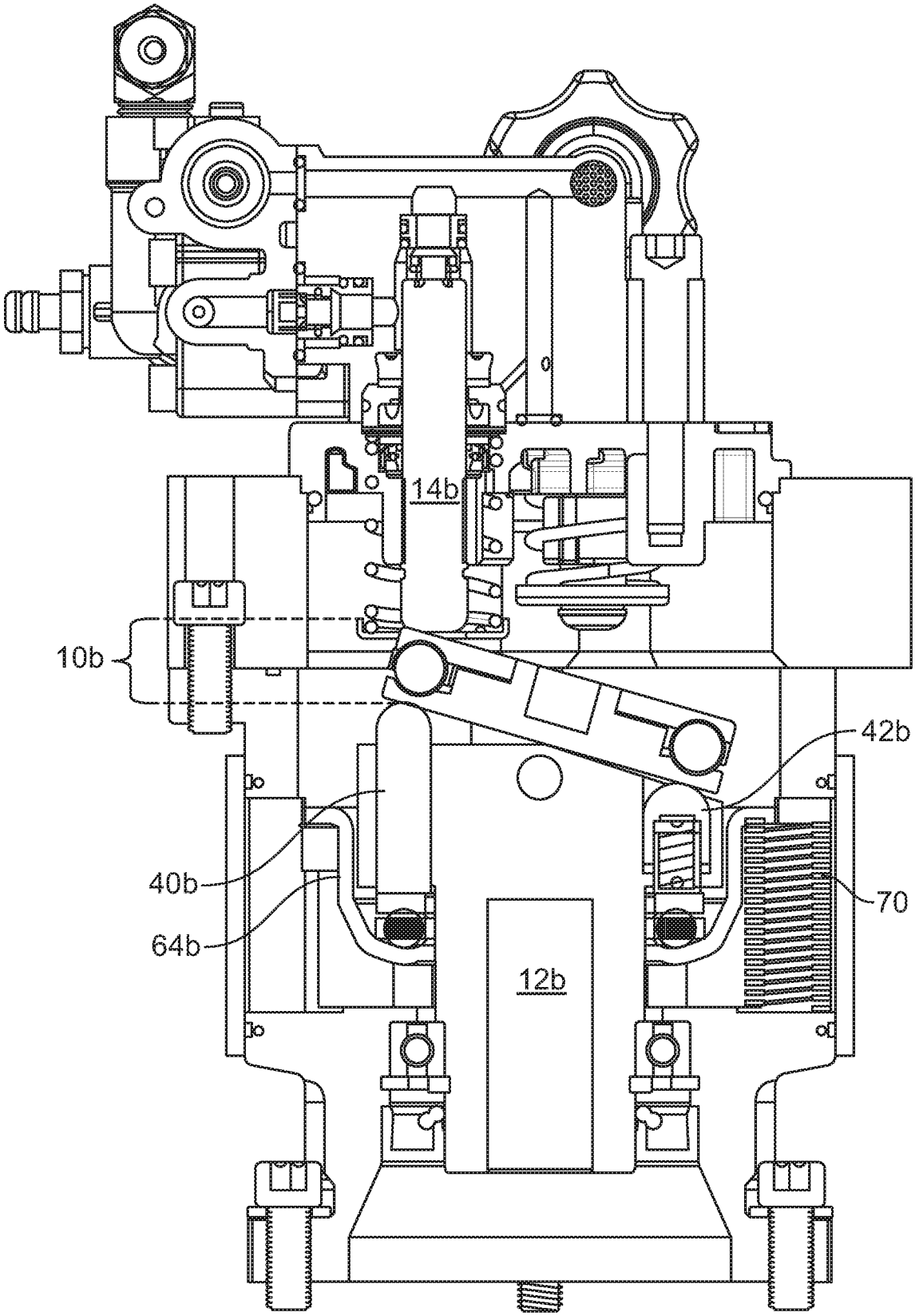
FIG. 22 diagrammatically depicts the variable flow pump according the third illustrative example embodiment.

Referring to FIGS. 21 through 22, another example embodiment of a variable flow pump consistent with the present disclosure is shown. Similar to the previously described embodiments, the variable flow pump may generally include a swashplate 10*b* that is coupled with a driveshaft 12*b*, such that the swashplate 10*b* may be rotatably driven by the driveshaft 12*b*. Further, the swashplate 10*b* may be moveable between at least a first tilt angle relative to the driveshaft 12*b* (e.g., as generally shown in FIG. 21) and a second tilt angle relative to driveshaft 12*b* (e.g., as generally shown in FIG. 22). Consistent with the present disclosure, while the embodiments are generally described in terms of the swashplate being moveable between at least a first tilt angle and a second tilt angle relative to the driveshaft, it will be appreciated that a swashplate consistent with the present disclosure may be moveable between more than two tilt angles relative to the driveshaft, including a plurality of defines incremental tilt angles and/or may be continuously moveable between a maximum tilt angle and a minimum tilt angle relative to the driveshaft.

The variable flow pump may further include one, or more than one, piston pumps (e.g., piston pump 14*b*). The one or more piston pumps 14*b* may interact with the swashplate for reciprocatingly driving the piston pumps 14*b* during rotation of the swashplate 10*b*. As with the other embodiments herein, the stroke, or reciprocating displacement, of the piston pump 14*b* (and therein the per-stroke pumping volume) may be based upon, at least in part, the tilt angle of the swashplate 10*b*. In some embodiments, a plurality of piston pumps may be generally radially spaced around a longitudinal axis of the driveshaft 12*b*.

The variable flow piston pump may also include an actuator assembly. The actuator assembly may include one, or more than one actuator pistons (not shown). As described above, the actuator pistons may include, for example, a generally annular piston, one or more pistons radially spaced around the longitudinal axis of the driveshaft 12*b*, and/or various other suitable arrangements. The one, or more than one, actuator pistons may move between at least a first position and a second position based upon, at least in part, a pressure of the fluid pumped by the piston pumps 14*b* at a location downstream of the piston pumps 14*b* (e.g., which may be generally referred to as a downstream backpressure). The one or more actuator pumps may interact with the actuator body 64*b* for moving the actuator body between at least a first position (e.g., as generally shown in FIG. 21) and a second position (e.g., as generally shown in FIG. 22). It will be appreciated that, while the actuator pistons and the actuator body is disclosed as being moveable between at least a first position and a second position, in some embodiments the actuator pistons and the actuator body may be moveable between a multitude of positions, including a multitude of discrete positions (e.g., a multitude of indexed positions or steps), and/or may be continuously moveable between a maximum first position and a minimum second position.

The actuator assembly may further include one, or more than one, biasing member, e.g., which may urge the actuator body toward the second position. Further, the biasing member(s) may urge the actuator pistons (e.g., via the actuator body 64*b*) toward the second position of the actuator pistons. As shown, in the illustrative embodiment of FIGS. 21 and 22, the biasing members may include a plurality of individual springs (e.g., spring 70), which may be radially spaced around the longitudinal axis of the driveshaft 12*b*, and/or may be otherwise situated relative to the actuator body 64*b*. The plurality of individual springs may include, but are not limited to, coils springs, flat springs, hydraulic and/or pneumatic actuators, as well as various other suitable biasing members.

The actuator body 64*b* may be provided having a generally similar shape and/or structure as the previously described embodiment. For example, the actuator body 64*b* may include a hat, or collar, shaped member that may generally surround at least a portion of the driveshaft 12*b* and/or the swashplate 10*b*. The actuator body 64*b* may be shaped to support and/or locate the plurality of springs 70, such that the springs 70 may provide a biasing force on the actuator body 64*b*, urging the actuator body 64*b* toward the second position. Additionally, the actuator body 64*b* may support the actuator drivers (e.g., the swashplate driver 40*b* and the biasing driver 42*b*), which may urge the swashplate 10*b* between the first position and the second position based upon, at least in part, the actuator body 64*b* (e.g., and the actuator pistons) being in and/or moving between their respective first positions and second positions.

It will be appreciated that various features of the embodiment of a variable flow pump depicted in FIGS. 17 through 20 and of the embodiment of a variable flow pump depicted in FIGS. 21 through 22 have been described for the understanding of the particular features of the example embodiments. However, it will also be appreciated that embodiments of the variable flow pump may include various additional and/or alternative features (e.g., many of which may be similar to, or the same as, features discussed with respect to the preceding example embodiments). As such, the description of this embodiment of the variable flow pump should not be construed as being limited to the particularly discussed features.

A variety of features of the variable flow rate pump have been described. However, it will be appreciated that various additional features and structures may be implemented in connection with a pump according to the present disclosure. As such, the features and attributes described herein should be construed as a limitation on the present disclosure.

What is claimed is:

1. A variable flow pump comprising:

a swashplate coupled with a driveshaft for rotatably driving the swashplate, the swashplate movable between a first tilt angle relative to the driveshaft and a second tilt angle relative to the driveshaft;

a piston pump interacting with the swashplate for being reciprocatingly driven based upon, at least in part, the tilt angle of the swashplate;

an actuator piston moveable between a first position and a second position based upon, at least in part, a downstream backpressure of a fluid pumped by the piston pump, the actuator piston comprising a plurality of pistons radially spaced around a longitudinal axis of the driveshaft;

an actuator assembly moveable between a first position and a second position based upon, at least in part, the position of the actuator piston, the actuator assembly including a swashplate driver configured urge the swashplate between the first tilt angle and the second tilt angle, and a biasing driver configured to apply a force urging the swashplate into contact with the swashplate driver.

2. The variable flow pump according to claim 1, wherein the swashplate is pivotally coupled to the driveshaft for tilting movement relative to the driveshaft.

3. The variable flow pump according to claim 1, wherein the piston pump is radially spaced from a longitudinal axis of the driveshaft.

4. The variable flow pump according to claim 3, comprising a plurality of piston pumps radially spaced around the longitudinal axis of the driveshaft.

5. The variable flow pump according to claim 1, wherein the piston pump is reciprocatingly driven a relatively smaller displacement when the swashplate is at the first tilt angle, and the piston pump is reciprocatingly driven a relatively larger displacement when the swashplate is at the second tilt angle.

6. The variable flow pump according to claim 1, wherein at least a portion of the actuator piston is part the actuator assembly.

7. The variable flow pump according to claim 1, wherein the actuator piston comprises an annular piston positioned around a longitudinal axis of the driveshaft.

8. The variable flow pump according to claim 1, wherein the actuator assembly further comprises a biasing member biasing the actuator assembly toward the second position.

9. The variable flow pump according to claim 8, wherein the biasing member comprises a mainspring disposed around a longitudinal axis of the driveshaft.

10. The variable flow pump according to claim 8, wherein the biasing member comprises a plurality of springs radially spaced around a longitudinal axis of the driveshaft.

11. The variable flow pump according to claim 1, wherein the swashplate driver comprises a fixed-length member transmitting displacement between an actuator body of the actuator assembly and the swashplate.

12. The variable flow pump according to claim 1, wherein the biasing driver comprises an expandable member disposed between an actuator body of the actuator assembly and the swashplate.

13. The variable flow pump according to claim 12, wherein the expandable member comprises a spring loaded pin.

14. A variable flow pump comprising:

a swashplate coupled with a driveshaft for rotatably driving the swashplate, the swashplate movable between a first tilt angle relative to the driveshaft and a second tilt angle relative to the driveshaft;

a piston pump interacting with the swashplate for being reciprocatingly driven based upon, at least in part, the tilt angle of the swashplate;

an actuator piston moveable between a first position and a second position based upon, at least in part, a downstream backpressure of a fluid pumped by the piston pump; and an actuator assembly moveable between a first position and a second position based upon, at least in part, the position of the actuator piston, the actuator assembly including:

a swashplate driver configured urge the swashplate between the first tilt angle and the second tilt angle, a biasing driver configured to apply a force urging the swashplate into contact with the swashplate driver, and a biasing member biasing the actuator assembly toward the second position, the biasing member comprising a plurality of springs radially spaced around a longitudinal axis of the driveshaft.

15. The variable flow pump according to claim 14, wherein the swashplate is pivotally coupled to the driveshaft for tilting movement relative to the driveshaft.

16. The variable flow pump according to claim 14, wherein the piston pump is reciprocatingly driven a relatively smaller displacement when the swashplate is at the first tilt angle, and the piston pump is reciprocatingly driven a relatively larger displacement when the swashplate is at the second tilt angle.

17. A variable flow pump comprising:

a swashplate coupled with a driveshaft for rotatably driving the swashplate, the swashplate movable between a first tilt angle relative to the driveshaft and a second tilt angle relative to the driveshaft;

a piston pump interacting with the swashplate for being reciprocatingly driven based upon, at least in part, the tilt angle of the swashplate;

an actuator piston moveable between a first position and a second position based upon, at least in part, a downstream backpressure of a fluid pumped by the piston pump;

an actuator assembly moveable between a first position and a second position based upon, at least in part, the position of the actuator piston, the actuator assembly including a swashplate driver configured urge the swashplate between the first tilt angle and the second tilt angle, and a biasing driver configured to apply a force urging the swashplate into contact with the swashplate driver, the biasing driver comprising an expandable member disposed between an actuator body of the actuator assembly and the swashplate.

18. The variable flow pump according to claim 17, wherein the expandable member comprises a spring loaded pin.

19. The variable flow pump according to claim 17, wherein the swashplate is pivotally coupled to the driveshaft for tilting movement relative to the driveshaft.

20. The variable flow pump according to claim 17, wherein the piston pump is reciprocatingly driven a relatively smaller displacement when the swashplate is at the first tilt angle, and the piston pump is reciprocatingly driven a relatively larger displacement when the swashplate is at the second tilt angle.

* * * * *